US005969284A

United States Patent [19]

Yamamoto et al.

[11] Patent Number: 5,969,284

[45] Date of Patent: Oct. 19, 1999

[54] MUSIC APPARATUS USING BOOLEAN AND NUMERICAL PARAMETERS SETTABLE BY MANIPULATOR

[75] Inventors: Takao Yamamoto; Toshifumi Kunimoto; Takeshi Komano; Chifumi Takeuchi, all of Hamamatsu, Japan

[73] Assignee: Yamaha Corporation, Hamamatsu, Japan

[21] Appl. No.: 09/005,784

[22] Filed: Jan. 12, 1998

[30] Foreign Application Priority Data

Jan. 13, 1997 [JP] Japan ..... 9-004141

[51] Int. Cl.[6] ..... G10H 7/00; G10H 7/10

[52] U.S. Cl. ..... 84/622; 84/601; 84/623; 84/625; 84/626; 364/723

[58] Field of Search ..... 84/601–606, 608–609, 84/615, 622–625, 626–633, 607; 364/723

[56] References Cited

U.S. PATENT DOCUMENTS 4,478,124 10/1984 Kikumoto .
5,665,928 9/1997 Wang ..... 84/621

FOREIGN PATENT DOCUMENTS 58-40593 3/1983 Japan .

*Primary Examiner*—Robert E. Nappi
*Assistant Examiner*—Marlon T. Fletcher
*Attorney, Agent, or Firm*—Graham & James LLP

[57] ABSTRACT

A parameter setting apparatus is provided in an electronic music instrument for editing a configure of parameters in accordance with a manipulation amount to set a tone generator which creates a desired timbre of musical tones upon setting. In the apparatus, a first memory device stores a first subset of parameters containing a Boolean parameter having a first Boolean value and a numerical parameter having a first numerical value. A second memory device stores a second subset of parameters containing the Boolean parameter having a second Boolean value and the numerical parameter having a second numerical value. An operating device provides a manipulation amount for editing parameters. An interpolating device interpolates the first numerical value and the second numerical value in accordance with the manipulation amount to determine an edited numerical value of the numerical parameter. A selecting device selects one of the first Boolean value and the second Boolean value in accordance with the manipulation amount to determine an edited Boolean value of the Boolean parameter. A setting device configure the tone generator with the set of parameters containing the numerical parameter having the edited numerical value and the Boolean parameter having the edited Boolean value.

15 Claims, 15 Drawing Sheets

ROM
CPU PROGRAM
TONEPARp1
TONEPARp2
TONEPARpm
301
302

AUXILILARY MEMORY DEVICE
TONEPARd1
TONEPARd2
TONEPARdk

TONEPAR
COMPAR
SCENE1
SCENE1

RAM
CPU WORK AREA
COMPARBUF
SCENEBUF1
SCENEBUF2
SCENEBUFintp
TONEPARu1
TONEPARu2
TONEPARun
TONEBUF
201
202
203
204
USER_TONES PARAMETER REGISTERS IN TONE GENERATOR
TGPARREGch1
TGPARREGch2
TGPARREGchj COMPARchj
SCENEchj

FIG.13(a)

DATA STRUCTURE OF SCENEi

| | |
|---|---|
| | VCODETUNE |
| VCOPAR | VCOWAVE |
| | |
| | |
| | FILTERTYPE |
| VCFPAR | CUTOFFFREQ |
| | Q |
| | |
| | |
| VCAPAR | VCAEGDATA |
| | TREMOLOSPEED |
| | TREMOLODEPTH |
| | CHORUS ON/OFF |
| | CHORUS DEPTH |
| EFCTPAR | MOD SPEED |
| | |
| | |

FIG.13(b)

PARAMETER DATA INCLUDED IN SCENEi AND FUNCTIONS THEREOF

| TYPE | DATA FUNCTION NAME | VALUE |
|---|---|---|
| NUMERICAL | VCO PITCH DEVIATION | −64∼+63 |
| BOOLEAN | VCO WAVEFORM DESIGNATION | 0:SINE, 1:SAWTOOTH, 2:SQUARE |
| | | |
| | | |
| BOOLEAN | FILTER TYPE | 0:LPF, 1:HPF, 2:BPF |
| NUMERICAL | CUTOFF FREQUENCY | 0∼127 |
| NUMERICAL | FILTER Q VALUE | 0∼127 |
| | | |
| | | |
| NUMERICAL | AMPLITUDE CONTROL EG PARAMETER GROUP | EACH 0∼127 |
| NUMERICAL | TREMOLO SPEED | 0∼127 |
| NUMERICAL | TREMOLO DEPTH | 0∼127 |
| BOOLEAN | CHORUS EFFECT ON/OFF | 0:OFF, 1:ON |
| NUMERICAL | CHORUS DEPTH | 0∼127 |
| NUMERICAL | MODULATION SPEED | 0∼127 |
| | | |
| | | |

FIG.14

CONTENTS OF COMPAR

| | |
|---|---|
| TONENAME | TIMBRE SET NAME |
| VOLUME | VOLUME VALUE |
| MODE | SINGLE/DUAL/SPLIT |
| TUNE | BASIC PITCH |
| | |
| | |

MUSIC APPARATUS USING BOOLEAN AND NUMERICAL PARAMETERS SETTABLE BY MANIPULATOR

BACKGROUND OF THE INVENTION

1. Field of the Invention

The present invention generally relates to a music tone parameter setting apparatus and a music tone synthesizing apparatus, suitable for an electronic musical instrument or the like. For example, the present invention is applicable to amusement apparatuses such as a game machine and a karaoke machine, household electrical appliances such as a television receiver, computers such as a personal computer, and a system in which these machines and appliances are integrated.

2. Description of Related Art

A conventional electronic musical instrument allows a user to select timbres of piano, cembalo and so on by operating a timbre select switch and the like provided in the electronic musical instrument. Generally, the electronic musical instrument stores the timbre parameters for these timbres. When the user selects a desired timbre, corresponding timbre parameters are set in the electronic musical instrument.

An electronic musical instrument is disclosed in Japanese Non-examined Patent Publication No. Hei 7-129167, in which a plurality of subsets (one subset is hereafter referred to as a scene or situation) of the above-mentioned timbre parameters are stored. Each scene may contain operation states of timbre setting keys operated by the user in place of the timbre parameters. The electronic musical instrument switches the scenes to change the timbre. Further, the electronic musical instrument can create timbre parameters for an intermediate state between the scenes. Namely, in the electronic musical instrument of this type, a timbre to be set with a timbre setting switch or the like is determined by a set of plural scenes and states between these scenes. Therefore, the timbres to be set with the timbre setting switch or the like are hereafter referred to as a timbre set.

In the above-mentioned conventional electronic musical instrument, control for outputting a continuous operational quantity or manipulation amount is arranged. By interpolating timbre parameters associated with plural scenes according to the operational quantity of the control, a desired timbre between the scenes can be obtained. Also, an automatic or programmed interpolation value varying with time may be used instead of the control operational quantity, such that a timbre can be made gradually transient automatically from one scene to another scene.

While some timbre parameters can be expressed in continuous numerical data within a predetermined range, for example, 0 to 127 (the parameters of this type are hereafter referred to as numerical parameters), other timbre parameters are expressed only in several discrete states (the parameters of this type are hereafter referred to as Boolean parameters). The Boolean parameters include those for designating turning on/off of various capabilities, filters LPF, BPF and HPF, monotony and polyphony, and waveforms including sine, triangle, sawtooth, and square.

However, it is impossible for the conventional electronic musical instrument to make a smooth scene-to-scene transition involving such Boolean parameters. To be more specific, changing Boolean parameters during a scene-to-scene transition causes a noise or alters a timbre abruptly, thereby giving a listener unnatural or uneasy impression.

Overcoming this problem requires setting of a common Boolean parameter to plural scenes or subsets included in one timbre set. However, this adds constraints to musical expression.

SUMMARY OF THE INVENTION

It is therefore a first object of the present invention to provide a music tone parameter setting apparatus and a music tone synthesizing apparatus, that allow smooth transition of a timbre if Boolean parameters are changed during the transition, thereby providing a variety of musical expressions. A second object of the present invention is to enhance the operational efficiency in setting a variety of timbre parameters.

According to one aspect of the invention, a parameter setting apparatus edits a set of parameters in accordance with a manipulation amount to set a tone generator which creates a desired timbre of musical tones upon setting. In the apparatus, a first memory device stores a first subset of parameters containing a Boolean parameter having a first Boolean value and a numerical parameter having a first numerical value. A second memory device stores a second subset of parameters containing the Boolean parameter having a second Boolean value and the numerical parameter having a second numerical value. An operating device provides a manipulation amount for editing parameters. An interpolating device interpolates the first numerical value and the second numerical value in accordance with the manipulation amount to determine an edited numerical value of the numerical parameter. A selecting device selects one of the first Boolean value and the second Boolean value in accordance with the manipulation amount to determine an edited Boolean value of the Boolean parameter. A setting device sets the tone generator with the set of parameters containing the numerical parameter having the edited numerical value and the Boolean parameter having the edited Boolean value.

According to another aspect of the invention, a parameter setting apparatus edits a set of parameters in accordance with a manipulation amount to set a tone generator which creates a desired timbre of musical tones upon setting. In the apparatus, a first memory device stores a first subset of parameters. A second memory device stores a second subset of parameters, which is a different version of the first subset. An operating device provides a manipulation amount for editing the parameters. An interpolating device interpolates the parameters between the first subset and the second subset in accordance with the manipulation amount to determine an edited subset of the parameters. An additional operating device can be actuated to designate one of the first subset and the second subset to determine a default subset of the parameters. A setting device sets the tone generator with the set of the parameters containing the edited subset, and otherwise sets the tone generator with the set of the parameters containing the default subset regardless of the manipulation amount when the additional operating device is actuated.

According to another aspect of the invention, a music apparatus comprises generating means set by timbre parameters to generate musical tones having a desired timbre, first memory means storing the timbre parameters of a first situation or scene which contains a Boolean timbre parameter having a first Boolean value and a numerical timbre parameter having a first numerical value, second memory means storing the timbre parameters of a second situation or scene which is a different version of the first scene and which contains the Boolean timbre parameter having a second Boolean value and the numerical timbre parameter having a second numerical value, operating means for inputting a manipulation amount to edit the timbre parameters, interpolating means for interpolating the first numerical value and the second numerical value in accordance with the manipulation amount to determine an edited numerical value of the numerical timbre parameter, selecting means for selecting one of the first Boolean value and the second Boolean value in accordance with the manipulation amount to determine an edited Boolean value of the Boolean timbre parameter, and setting means for setting the generating means with the timbre parameters of an edited situation or scene which contains the numerical timbre parameter having the edited numerical value and the Boolean timbre parameter having the edited Boolean value.

According to another aspect of the invention, a music apparatus comprises generating means set by timbre parameters to generate musical tones having a desired timbre, first memory means storing the timbre parameters of a first scene, second memory means storing the timbre parameters of a second scene which is a different version of the first scene, edit operating means for inputting a manipulation amount to edit the timbre parameters, interpolating means for interpolating the timbre parameters between the first scene and the second scene in accordance with the manipulation amount to create an edited scene of the timbre parameters, default operating means optionally actuated to designate one of the first scene and the second scene as a default scene of the timbre parameters, and setting means for setting the generating means with the timbre parameters of the edited scene and otherwise for setting the generating means with the timbre parameters of the default scene regardless of the manipulation amount when the default operating means is optionally actuated.

According to a further aspect of the invention, a machine readable medium is used in a music machine having a CPU for setting a desired timbre of musical tones by timbre parameters. The medium contains program instructions executable by the CPU to perform the steps of provisionally providing the timbre parameters of a first scene which contains a Boolean timbre parameter having a first Boolean value and a numerical timbre parameter having a first numerical value, provisionally providing the timbre parameters of a second scene which is a different version of the first scene and which contains the Boolean timbre parameter having a second Boolean value and the numerical timbre parameter having a second numerical value, providing a manipulation amount to edit the timbre parameters, interpolating the first numerical value and the second numerical value in accordance with the manipulation amount to determine an edited numerical value of the numerical timbre parameter, selecting one of the first Boolean value and the second Boolean value in accordance with the manipulation amount to determine an edited Boolean value of the Boolean timbre parameter, and setting the desired timbre of the musical tones by the timbre parameters of an edited scene which contains the numerical timbre parameter having the edited numerical value and the Boolean timbre parameter having the edited Boolean value.

According to a further aspect of the invention, a machine readable medium is used in a music machine having a CPU for setting a desired timbre of musical tones by timbre parameters. The medium contains program instructions executable by the CPU to perform the steps of provisionally providing the timbre parameters of a first scene, provisionally providing the timbre parameters of a second scene which is a different version of the first scene, providing a manipulation amount for editing the timbre parameters, interpolating the timbre parameters between the first scene and the second scene in accordance with the manipulation amount to create an edited scene of the timbre parameters, optionally designating one of the first scene and the second scene as a default scene of the timbre parameters, setting the desired timbre of the musical tones by the timbre parameters of the edited scene, and alternatively setting a default timbre of the musical tones by the timbre parameters of the default scene regardless of the manipulation amount when the default scene is optionally designated.

BRIEF DESCRIPTION OF THE DRAWINGS

These and other objects of the invention will be seen by reference to the description, taken in connection with the accompanying drawing, in which:

FIG. 13(*a*) and FIG. 13(*b*) are diagrams illustrating data formats of the above-mentioned preferred embodiment;

FIG. 14 is a diagram illustrating another data format of the above-mentioned preferred embodiment.

DETAILED DESCRIPTION OF PREFERRED EMBODIMENTS

This invention will be described in further detail by way of example with reference to the accompanying drawings.

1. Constitution of the Embodiment

Figure 1:
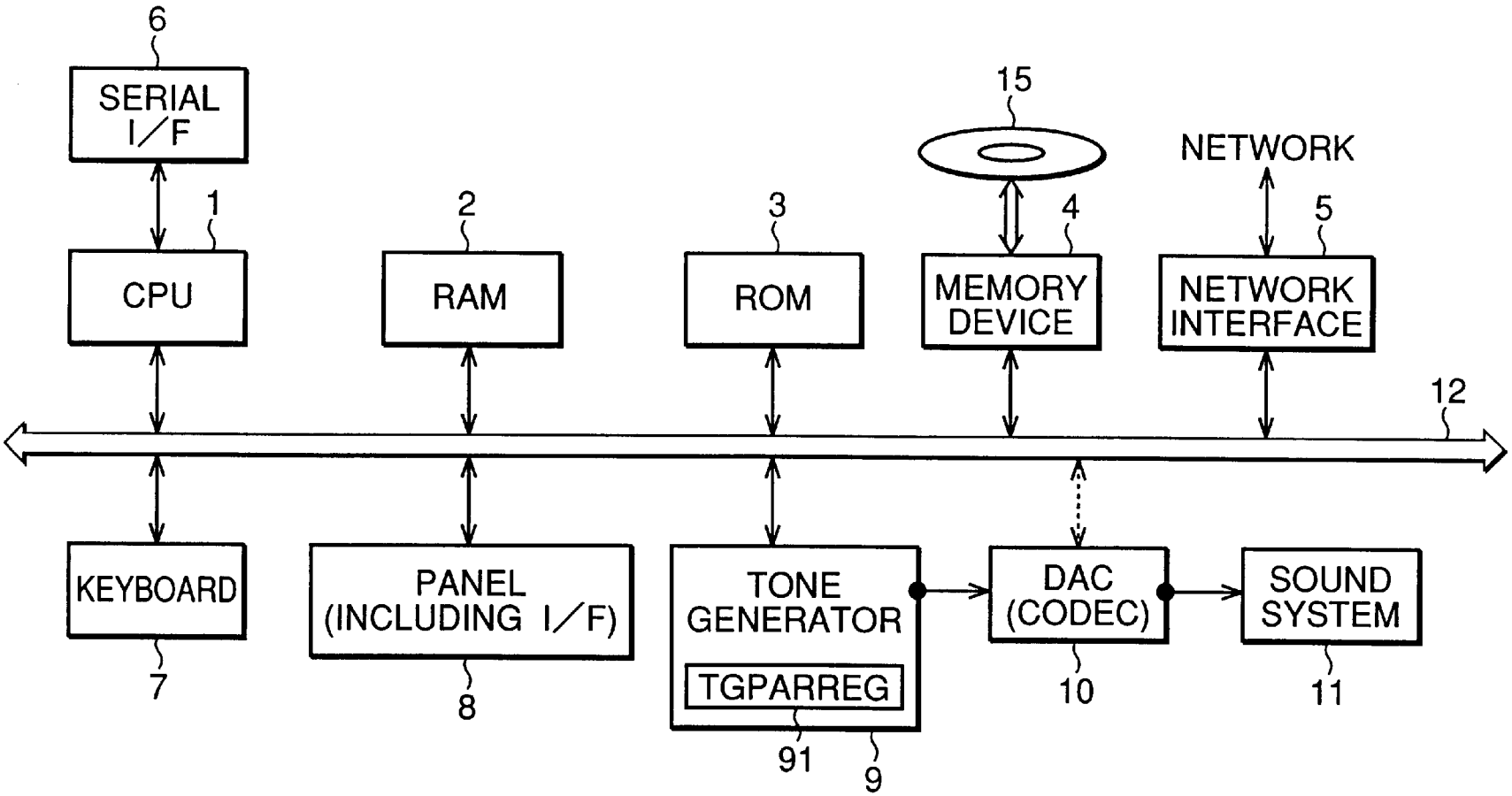
FIG. 1 is a block diagram illustrating an electronic music apparatus practiced as one preferred embodiment of the present invention.

Now, referring to FIG. 1, reference numeral 1 denotes a CPU that controls other components of the preferred embodiment of a music apparatus based on control programs stored in a RAM 2 or a ROM 3. Reference numeral 4 denotes an auxiliary memory device which is constituted by a floppy disc drive, a hard disc drive, a CD-ROM drive, or an MO drive. The auxiliary memory device 4 receives a machine readable medium 15 such as floppy disc, CD-ROM disc or MO disc. Reference numeral 5 denotes a network interface that is connected to a network to transfer timbre parameters and play information with an external computer.

Reference numeral 6 denotes a serial interface that inputs and outputs play information and other serial data. Reference numeral 7 denotes a keyboard as an example of a play control. Reference numeral 8 denotes a panel containing a display constituted by a CRT or an LCD for example and setting controls for setting timbres. Reference numeral 9 denotes a tone generator for synthesizing a digital music tone signal based on the play information supplied over a bus 12.

The tone generator 9 has a TG parameter register 91 (TGPRREG) for holding TG parameters of channels 1 to j. The TG parameter is constituted by a coefficient or else, and is determined by a timbre parameter. The TG parameter is supplied to components of the tone generator 9. Reference numeral 10 denotes a DA converter for converting a digital music tone signal into an analog equivalent for output. Reference numeral 11 denotes a sound system for sounding the music tone signal outputted from the DA converter 10.

Figure 2:
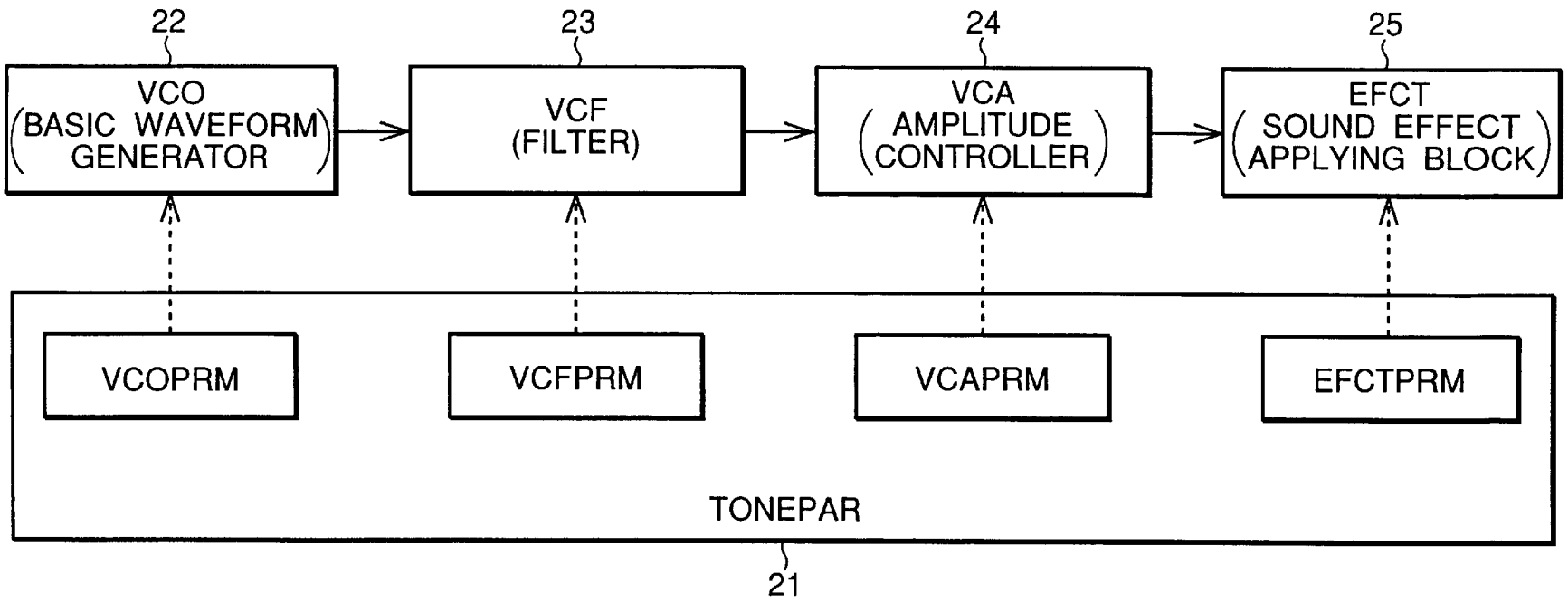
FIG. 2 is block diagram illustrating one channel of a tone generator installed in the above-mentioned preferred embodiment.

The following describes one channel of the tone generator 9 with reference to FIG. 2. In the figure, reference numeral 21 denotes a timbre parameter set TONEPAR for each channel. This timbre parameter set TONEPAR includes a waveform parameter VCOPRM for determining the basic waveform of a music tone, a filter parameter VCFPRM for determining filter characteristic, an amplitude control parameter VCAPRM for determining amplitude control characteristic, and a sound effect parameter EFCTPRM for determining various sound effects.

Reference numeral 22 denotes a basic waveform generator (VCO) for generating the basic waveform of a music tone according to the waveform parameter VCOPRM. Reference numeral 23 denotes a filter (VCF) for performing various filtering operations on the basic waveform according to the filter parameter VCFPRM.

Reference numeral 24 denotes an amplitude controller (VCA) for amplitude-modulating a filtered music tone signal based on the amplitude control parameter VCAPRM. Reference numeral 25 denotes an sound effect applying block (EFCT) for applying various effects to a music tone signal outputted from the amplitude controller 24 based on the sound effect parameter EFCTPRM. It should be noted that, actually, the timbre parameter set TONEPAR is converted into the TG parameter set before being supplied to the corresponding components of the tone generator.

Figure 3:
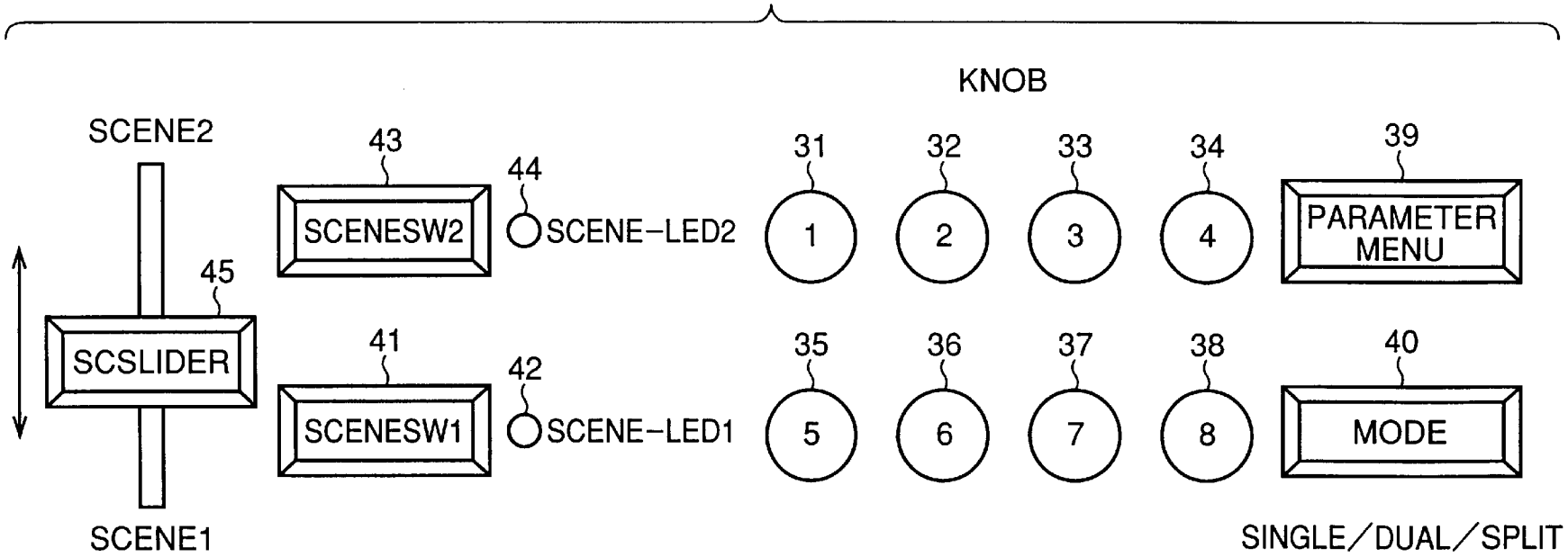
FIG. 3 is an elevational view illustrating a main portion of a control panel of the above-mentioned preferred embodiment.

The following describes the main constitution of the setting control in the panel 8 with reference to FIG. 3. In the figure, reference numeral 41 denotes a first scene select switch for selecting a first scene (first subset) of a selected timbre set. Likewise, reference numeral 43 denotes a second scene select switch for selecting a second scene (second subset) of the selected timbre set.

Reference numeral 42 denotes a first scene selection indicator composed of an LED that is turned on when the first scene is selected. Likewise, reference numeral 44 denotes a second scene selection indicator composed of an LED that is turned on when the second scene is selected. Reference numeral 45 denotes a slider for outputting an operational quantity or manipulation amount 0 to 127 according to a position to which the slider is moved. This operational quantity is used, for example, for the factor of interpolating the first and second scenes.

Before selecting a scene by operating the first or second scene select switch 41 or 43, a timbre set must be designated. A timbre set select switch is constituted in substantially the same manner as that used in a known electronic musical instrument.

Reference numeral 39 denotes a parameter menu select switch for selecting a parameter group for the currently selected scene (hereafter referred to as a current scene) indicated by one of the scene indicators 42 and 44. The timbre parameters that can be set in the electronic musical instrument practiced as the present embodiment are divided into eight groups. Every time the parameter menu select switch 39 is pressed, one of the parameter groups is selected in a cyclic manner.

These parameter groups include a group constituting the above-mentioned waveform parameter VCOPRM, a group constituting the above-mentioned filter parameter VCFPRM, a group constituting the above-mentioned sound effect parameter EFCTPRM, and a group constituting the above-mentioned amplitude control parameter VCAPRM, for example. Reference numerals 31 through 38 denote knobs of rotary type each for adjusting the individual timbre parameter belonging to a selected parameter group.

The timbre parameters that can be set with the knobs 31 through 38 are of both numerical and Boolean types. The currently selected parameter group, the individual timbre parameters assigned to the knobs 31 through 38, and the setting values of these parameters are shown on the display of the panel 8.

It should be noted that the constitution of the knobs 31 through 38 and the parameter menu switch 39 is one of the features of the present embodiment. To be more specific, in the present embodiment, a total of 64 timbre parameters can be set by the eight knobs 31 through 38 and the parameter menu select switch 39, so that only the small number of knobs may be arranged as compared with the number of timbre parameters. This lowers the fabrication cost of the electronic musical instrument. Further, the timbre parameters can be set by rotating corresponding knob, hence the user can get substantially the same sense of operation as provided on a so-called analog synthesizer. This is a significant advantage for users familiar with the analog synthesizer.

Reference numeral 40 denotes a mode select switch for selecting operating modes of single, dual, and split in a cyclic manner. The selected mode is indicated on the display of the panel 8. The meanings of these operating modes are the same as those of the conventional electronic musical instrument. To be more specific, in the single mode, a music tone is sounded in monotony. In the dual mode, a duet is performed. In the split mode, one of two music tones is sounded according to a play operating condition such as key range and key pressing velocity.

2. Data Structure of the Embodiment

Figures 12A, 12B, 12C, 12D, 12E, 12F:
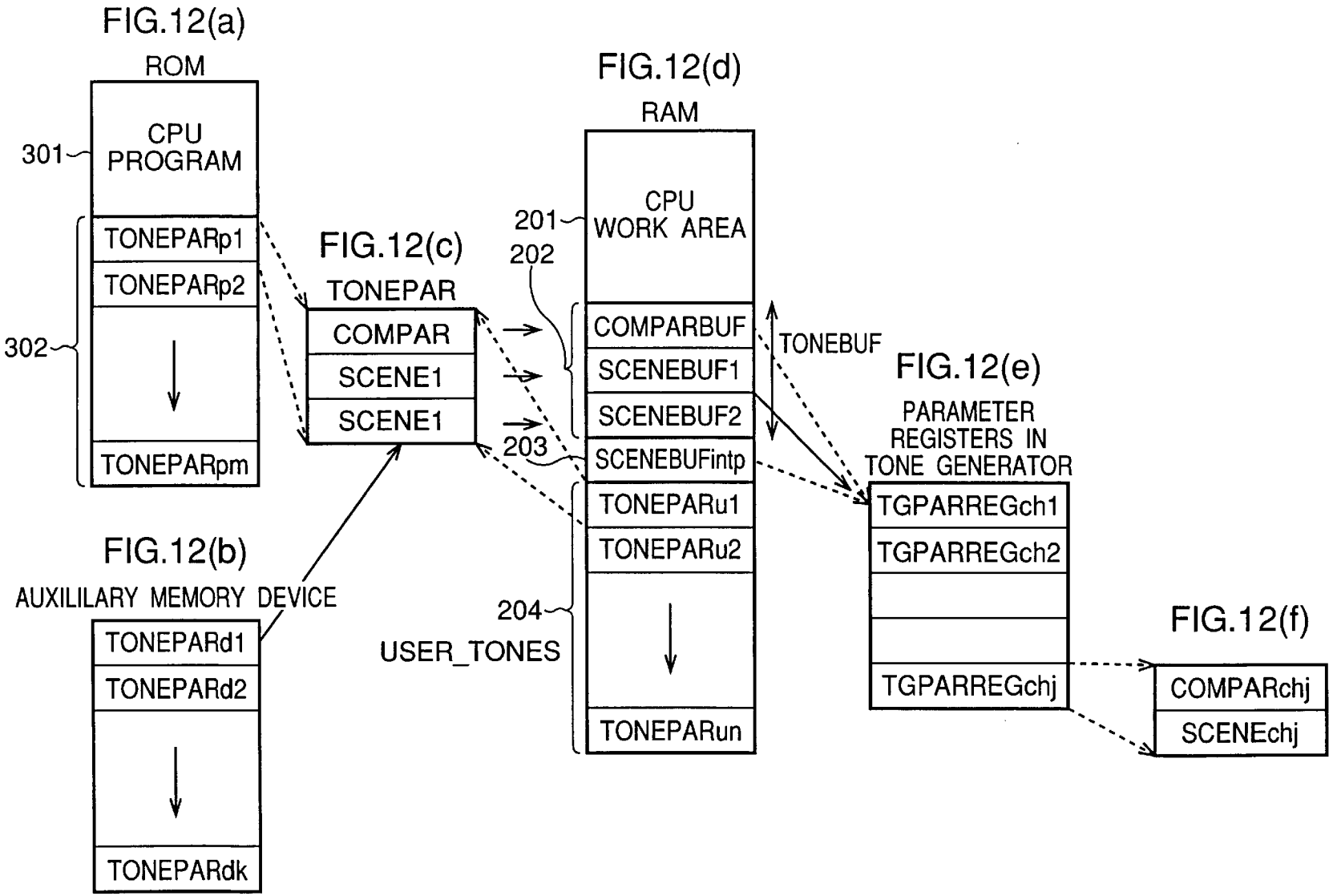
FIG. 12(*a*) through FIG. 12(*f*) are diagrams illustrating memory maps of the above-mentioned preferred embodiment.

The following describes a data structure used in the present embodiment with reference to FIGS. 12(*a*) through 12(*f*). FIG. 12 (*a*) illustrates a data map of the ROM 3. The ROM 3 is composed of a program area 301 for storing a program and a preset timbre set storage area 302 for storing m preset timbre sets TONEPARp1 through TONEPARpm. It should be noted that the timbre sets may also be supplied to the electronic musical instrument from the auxiliary memory device 4 or from some source via a network. As shown in FIG. 12(*b*), these timbre sets are referred to as external timbre sets TONEARd1 through TONEPARdk.

FIG. 12(*d*) illustrates a memory map of the RAM 2. The RAM 2 is composed of a work area 201 for storing variables and so on for use by the program, a tone buffer area 202 (TONEBUF) for storing currently used timbre parameters, an interpolated data area 203 (SCENEBUFintp) for storing interpolated timbre parameters and so on, and a user area 204 for storing timbre sets designated by the user. It should be noted that the user area 204 can store up to n timbre sets, which are user timbre sets TONEPARu1 through TONEPARun.

The preset timbre sets TONEPARp1 through TONEPARpm, the external timbre sets TONEPARd1 through TONEPARdk, and the user timbre sets TONEPARu1 through TONEPARun have the same data structure, which is illustrated in FIG. 12(*c*). In the figure, one timbre set is composed of common parameters COMPAR shared by the first and second scenes or subsets, first scene unique parameters SCENE1, which are timbre parameters unique to the first scene, and second scene unique parameters SCENE2, which are timbre parameters unique to the second scene.

FIG. 13(*a*) illustrates a data structure of parameters SCENEi (i=1 or 2) unique to scene i. FIG. 14 illustrates a data structure of the common parameters COMPAR. As shown in FIG. 13(*b*), in the present embodiment, both Boolean and numeral parameters can be set as scene unique parameters. Therefore, most timbre parameters are included in the scene i unique parameters SCENEi, while the common parameters COMPAR are associated with timbre set name, operating mode, basic pitch, and so on as shown in FIG. 14.

The following describes the various parameters illustrated in FIG. 13(*b*). First, VCODETUNE denotes a numerical parameter for indicating how much the pitch of each scene is to be shifted relative to the basic pitch of the common parameter. VCOWAVE is a Boolean parameter for designating a waveform to be generated in the basic waveform generator 22, the waveform being selected from sine, sawtooth, or square.

FILTERTYPE is a Boolean parameter for designating a filter characteristic applied to the filter 23, the filter characteristic being selected from LPF, HPF, and BPF. CUTOFFFREQ and Q are numerical parameters for designating the cutoff frequency and Q value of a selected filter, respectively.

VCAEGDATA includes various timbre parameters for generating an envelope waveform for amplitude control. These parameters are the same as those used in the conventional electronic musical instrument and are of numerical type each. TREMOLOSPEED and TREMOLODEPTH are numerical parameters for designating speed and depth of tremolo.

CHORUS ON/OFF is a Boolean parameter for designating on/off of chorus effect. CHORUS DEPTH is a numerical parameter for designating depth of chorus. MOD SPEED is a numerical parameter for designating speed of modulation.

Referring to FIG. 12(*d*) again, the above-mentioned tone buffer area 202 has a storage capacity for one timbre set, and stores one of the above-mentioned various timbre sets that is selected by the user. In what follows, the common parameters COMPAR, the first scene unique parameters SCENE1, and the second scene unique parameters SCENE2 currently stored in the tone buffer area 202 are referred to as current common parameters COMPARBUF, current first scene unique parameters SCENEBUF1, and current second scene unique parameters SCENEBUF2, respectively. The interpolated data area 203 stores one of the current first scene unique parameters SCENEBUF1, the current second scene unique parameters SCENEBUF2, and interpolated parameters obtained by interpolating these parameters. In what follows, the timbre parameters stored in the interpolated data area 203 are referred to as scene buffer interpolation parameters SCENEBUFintp.

FIG. 12(*e*) illustrates a memory map of the TG parameter register 91 arranged in the tone generator 9. In the figure, the TG parameter register 91 is divided into areas corresponding to channels 1 through j. The portions corresponding to these channels are referred to as TG parameter registers TGPARREGch1 through TGPARREGchj, respectively. The TG parameter register TGPARREGchj for one channel is composed of a section storing scene dependent parameters SCENEchj which vary with scene switching or interpolation and another section storing scene common parameters COMPARchj which are independent of scene switching or interpolation as shown in FIG. 12(*f*).

Referring back to FIGS. 1 to 3, according to one aspect of the invention, in the music apparatus, generating means is composed of the tone generator 9 set by timbre parameters to generate musical tones having a desired timbre. First memory means is composed of the RAM 2 storing the timbre parameters of a first situation or scene which contains a Boolean timbre parameter having a first Boolean value and a numerical timbre parameter having a first numerical value. Second memory means is also composed of the RAM 2 storing the timbre parameters of a second situation or scene which is a different version of the first scene and which contains the Boolean timbre parameter having a second Boolean value and the numerical timbre parameter having a second numerical value. Operating means is composed of the slider 45 for inputting a manipulation amount to edit the timbre parameters. Interpolating means is functionally provided by means of the CPU 1 for interpolating the first numerical value and the second numerical value in accordance with the manipulation amount to determine an edited numerical value of the numerical timbre parameter. Selecting means is also provided by the CPU 1 for selecting one of the first Boolean value and the second Boolean value in accordance with the manipulation amount to determine an edited Boolean value of the Boolean timbre parameter. Setting means is also provided by the CPU 1 for setting the generating means with the timbre parameters of an edited situation or scene which contains the numerical timbre parameter having the edited numerical value and the Boolean timbre parameter having the edited Boolean value.

According to another aspect of the invention, the music apparatus has generating means in the form of the tone generator 9 set by timbre parameters to generate musical tones having a desired timbre. The RAM 2 contains first memory means storing the timbre parameters of a first scene, and second memory means storing the timbre parameters of a second scene which is a different version of the first scene. Edit operating means is provided in the form of the slider 45 for inputting a manipulation amount for editing the timbre parameters. Interpolating means is functionally provided by means of the CPU 1 for interpolating the timbre parameters between the first scene and the second scene in accordance with the manipulation amount to create an edited scene of the timbre parameters. default operating means is provided in the form of the scene select switches 41 and 43 which are optionally actuated to designate one of the first scene and the second scene as a default scene of the timbre parameters. Setting means is provided by the CPU 1 for setting the generating means with the timbre parameters of the edited scene and otherwise for setting the generating means with the timbre parameters of the default scene regardless of the manipulation amount when the default operating means is optionally actuated.

3. Operation of the Embodiment 3.1 Initialization and Others

Figure 4:
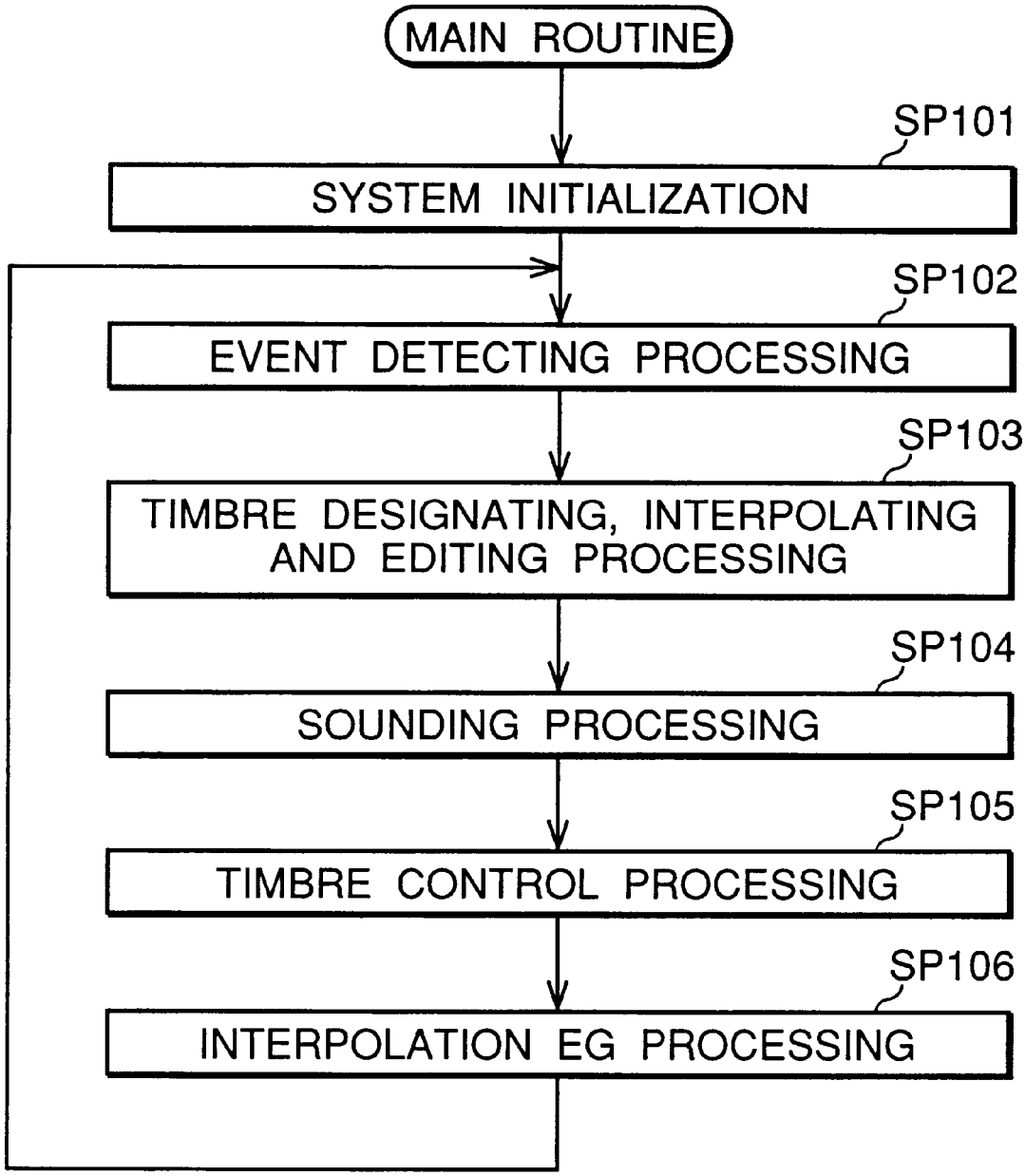
FIG. 4 is a flowchart of a main routine executed in the above-mentioned preferred embodiment.

The following describes the operation of the present embodiment. First, when the electronic music apparatus of the present preferred embodiment is powered on, the main routine shown in FIG. 4 is launched. In the flawchart, when the processing goes to step SP101, predetermined system initialization is executed. To be more specific, the preset timbre set TONEPARpl stored in the head of the preset timbre set storage area 302 is set as the default timbre set of the electronic musical instrument. That is, the contents of the preset timbre set TONEPARpl are transferred to the tone buffer area 202.

For the default scene, the first scene is selected. To be more specific, the first scene unique parameters SCENE1 of the preset timbre set TONEPARpl are transferred to the auxiliary data area 203. In the initialization, value "1" is written to a set flag setflg_1, and value "0" is written to another set flag setflg_2. To the predetermined variable CURRSCENE, value "1" indicating the first scene is written.

The set flags setflg_1 and setflg_2 indicate the corresponding scenes and interpolated states. To be more specific, when the first scene is selected, value "1" is written to the set flag setflg_1; when the second scene is selected, value "1" is written to the set flag setflg_2. When interpolation is executed between the first scene and the second scene, value "0" is written to both the set flags setflg_1 and setflg_2. Namely, the states of the set flags setflg_1 and setflg_2 do not necessarily match the current scene CURRSCENE uniquely. If the set flags setflg_1 and setflg_2 are both "0"s, the current scene CURRSCENE is set to either "1" or "2."

After step SP101, a main loop of steps SP102 through SP106 is repeated. The following describes the operation to be executed in this main loop. First, in step SP102, event detect processing is executed. To be more specific, this step detects occurrence of an event on the keyboard 7 and an event input such as a MIDI signal via the serial interface 6 or the network interface 5.

3.2 Timbre Select Event

Figure 5:
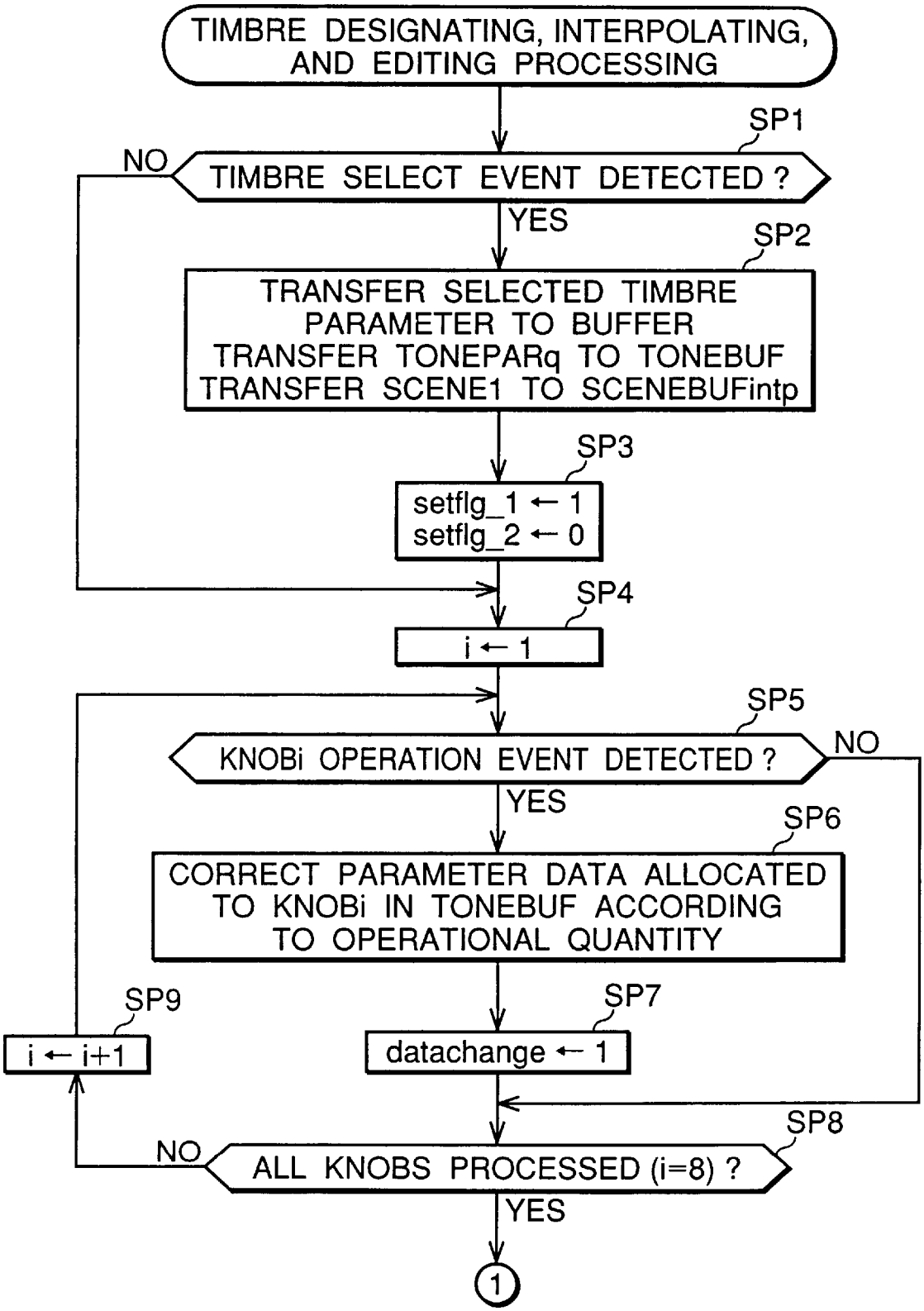
FIG. 5 is a flowchart of a subroutine executed in the above-mentioned preferred embodiment.
Figure 6:
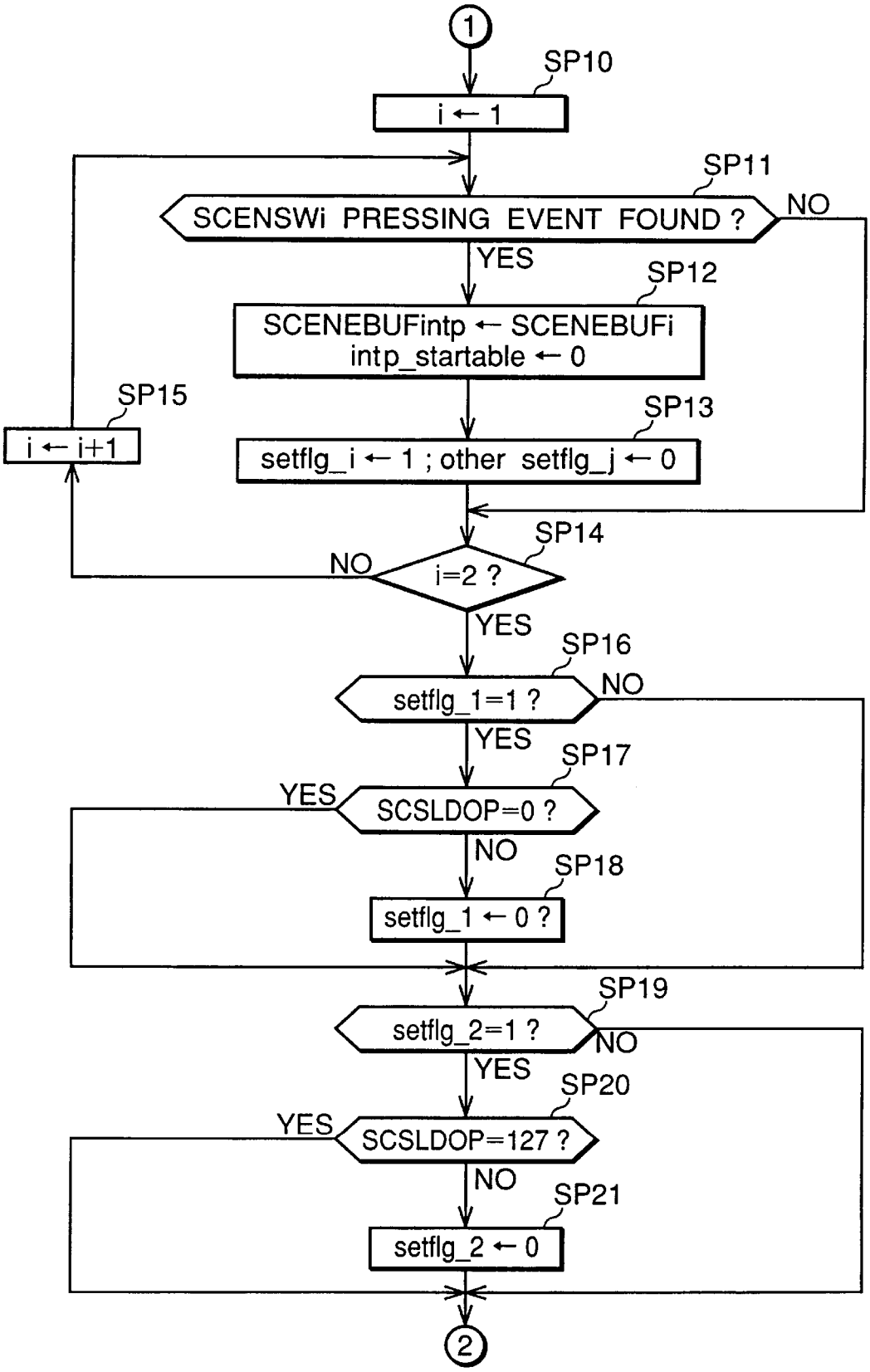
FIG. 6 is another flowchart of the above-mentioned subroutine.
Figure 7:
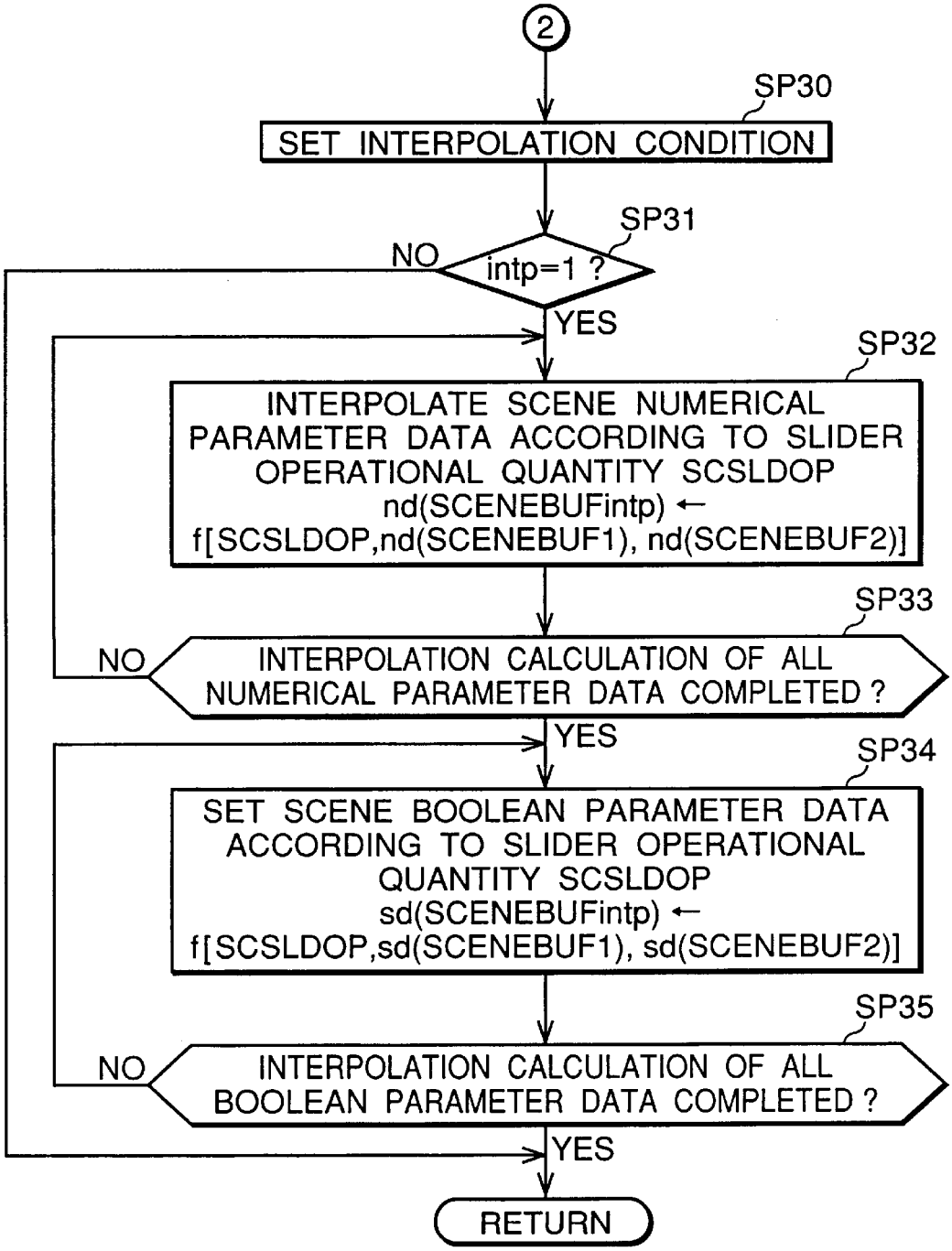
FIG. 7 is still another flowchart of the above-mentioned subroutine.

Next, in step SP103, subroutines shown in FIG. 5 through FIG. 7 are called to execute timbre designating processing, interpolating processing, and editing processing. The following describes these processing operations in detail.

In step SP1 shown in FIG. 5, it is determined whether a timbre select event has been detected in step SP102. The timbre select event denotes an event caused by operating the timbre select switch on the panel 8. It should be noted that an event such as program change of the MIDI signal inputted from the serial interface 6 for example is detected in step SP82 to be described later.

If the timbre select event is found, the decision is YES, then in step SP2, a newly selected timbre set TONEPARq (one selected from the preset timbre sets, the external timbre sets, and the user timbre sets) is transferred to the tone buffer area 202.

Next, the first scene unique parameters SCENE1 (the first subset) of the timbre set TONEPARq are transferred to the interpolated data area 203 as new scene buffer interpolation parameters SCENEBUFintp. At the same time, value "1" is written to the current scene CURRSCENE. Then, in step SP3, value "1" is written to the set flag setflg_1 and, value "0" is written to the set flag setflg_2. Thus, if a new timbre set is selected, the first scene is set as default. It should be noted that the second scene or an intermediate scene between the first and second scene may be used as default.

3.3 Knob Event Processing

In step SP4, value "1" is written to variable i. In step SP5, it is determined whether an event caused by operating knob i has been detected in step SP102. It should be noted that the knobs 31 through 38 shown in FIG. 3 correspond to the first through eighth knobs, respectively.

If the decision is YES, then, in step SP6, the current first scene unique parameters SCENEBUF1 or the current second scene unique parameters SCENEBUF2 in the tone buffer area 202, whichever is designated by the current scene CURRSCENE, is corrected. Namely, the value of the timbre parameter assigned to the knob i in advance is corrected according to the operational quantity of that knob.

Then, in step SP7, value "1" is written to variable datachange to indicate that some timbre parameter has been corrected. If no event has been caused on the knob i, steps SP6 and SP7 are skipped. In step SP8, it is determined whether the variable i is "8", or the knobs 31 through 38 have all been processed. Since the variable i is initially set to "1", the decision is NO. Then, in step SP9, the variable i is incremented by 1. Namely, the variable i is set to "2." Subsequently, the processing operations of steps SP5 through SP8 are repeated until the variable i becomes "8" to appropriately correct the timbre parameter for each knob.

3.4 Scene Select Event Processing

In step SP10 shown in FIG. 6, value "1" is written to the variable i again. Then, in step SP11, it is determined whether an event caused by operating a scene select switch i (namely, the first scene select switch 41) has been detected in step SP102. If the decision is YES, the processing goes to step SP12.

In step S12, scene unique parameter subset i (namely, the SCENEBUF1) in the tone buffer area 202 is transferred to the interpolated data area 203 as a new scene buffer interpolation parameter subset SCENEBUFintp. At the same time, value "1" is written to the current scene CURRSCENE, and a flag intp_startable is set to "0." The meaning of this flag will be described later.

Then, in step SP13, the set flag setflg_i (namely the setflg_1) is set to "1" and the other set flag setflg_j (namely the setflg_2) is set to "0." If the event in the first scene select switch 41 has not been detected, steps SP12 and SP13 are skipped.

Then, in step SP14, it is determined whether the variable i is "2" or not. Since the variable is initially "1", the decision is NO and the variable i is incremented by 1 in step SP15, upon which the routine returns to step SP11. Therefore, the same processing as described above will be performed on the second scene select switch 43.

To be more specific, if the event caused by operating the second scene select switch 43 has been detected, the contents of the current second scene unique parameter subset SCENEBUF2 is substituted into the scene buffer interpolation parameter subset SCENEBUFintp, the current scene CURRSCENE is set to "2", the set flag setflg_1 is set to "0" and the set flag setflg_2 is set to "1."

Thus, if the event of the first or second scene select switch 41 or 43 has been detected, the contents of the scene buffer interpolation parameter subset SCENEBUFintp is updated according to the event detected.

3.5 Slider Event Processing

In step SP102 shown in FIG. 4, the operational quantity of the slider 45 is also detected, and the detected value is substituted into a variable SCSLDOP. To be more specific, when the slider 45 has been moved fully to the first scene side (SCENE1) which is one extreme end, the slider operational quantity SCSLDOP is "0". When the slider 45 has been moved fully to the second scene side (SCENE2) which is the other extreme end, the slider operational quantity SCSLDOP is "127". When the slider 45 has been moved to an intermediate point between the first and second scenes, the slider operational quantity is between "1" to "126" inclusive, accordingly.

Now, referring to FIG. 6 again, in step SP16, it is determined whether the set flag setflg_1 is "1" or not. If it is assumed here that a timbre select event or an event of the first scene select switch 41 has been detected immediately before step SP16, the set flag setflg_1 is set to "1" in the above-mentioned step SP2 or SP13. Therefore, the decision is YES in this case and the processing goes to step SP17.

In step SP17, it is determined whether the slider operational quantity SCSLDOP is "0" or not (namely whether the slider 45 has been moved fully to the first scene side). If the decision is NO, the set flag setflg_1 is set to "0." Next, in step SP19, it is determined whether the set flag setflg_2 is "1" or not.

If it is assumed that an event of the second scene select switch 43 has been detected, the set flag setflg_2 should have been set to "1" in step SP13. Therefore, in such a case, the decision YES leads to step SP20. In step SP20, it is determined whether the slider operational quantity SCSLDOP is "127" (namely whether the slider 45 has been moved fully to the second scene side). If the decision is NO, then, in step SP21, the set flag setflg_2 is set to "0."

As described, if the timbre select event or the event of the first or second scene select switch has been detected, one of the set flag setflg_1 and the set flag setflg_2 is temporarily set to "1"; if the slider 45 is not positioned at the extreme end of the corresponding scene, that set flag is immediately set to "0."

3.6 Determination to Interpolate or Not

Figure 15:
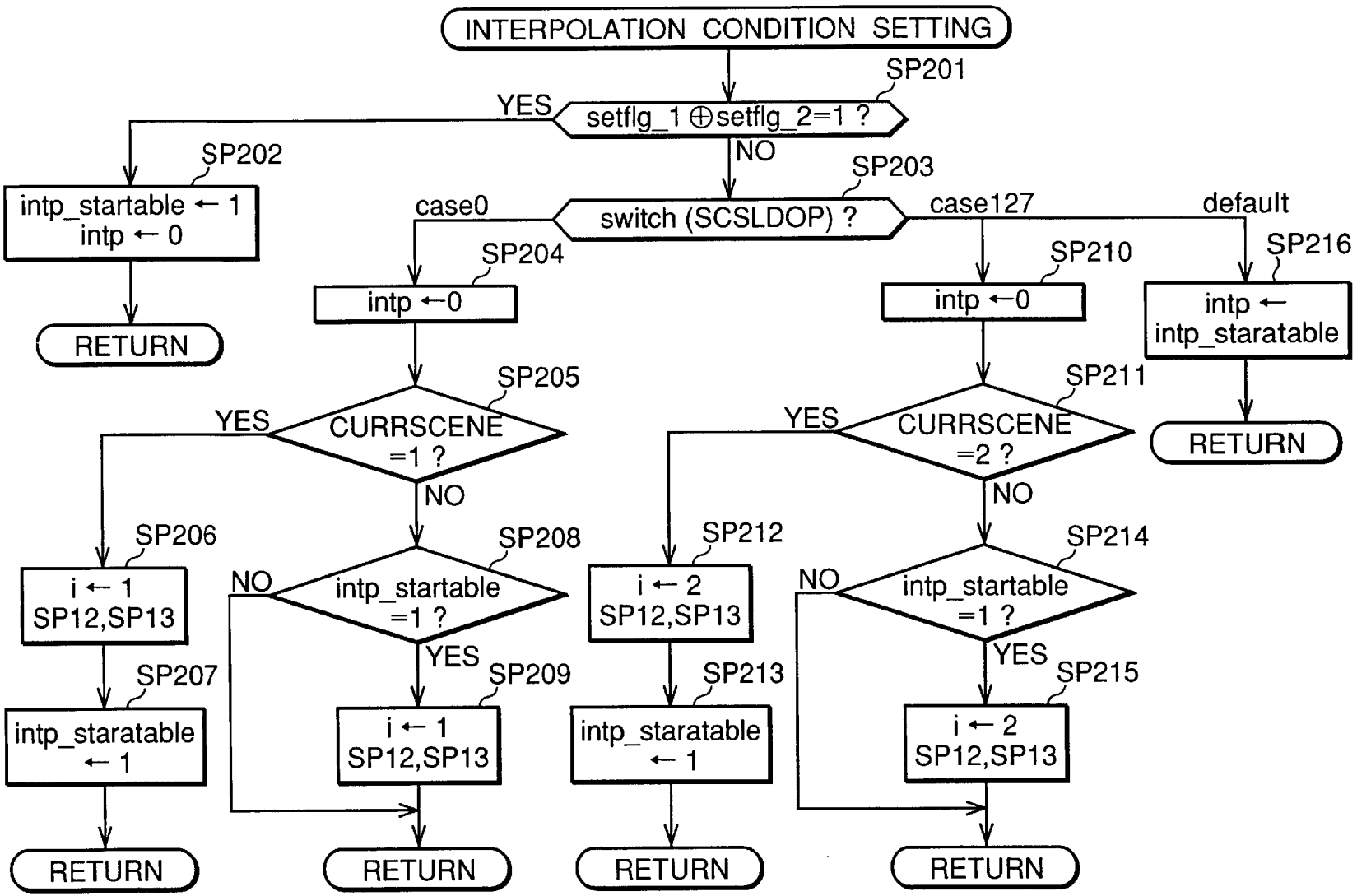
FIG. 15 is a flowchart of yet another subroutine executed in the above-mentioned preferred embodiment.

Next, in step SP30 shown in FIG. 7, a subroutine shown in FIG. 15 is called to execute interpolation condition reset processing. The following describes this processing in detail. Referring to FIG. 15, in step SP201, logical OR operation is executed between the set flag setflg_1 and the set flag setflg_2. Then, it is determined whether the result of this logical OR operation is "1" or not. The result is "1" if one of the set flag setflg_1 and the set flag setflg_2 is "1". Namely, the slider 45 has been moved fully to the corresponding scene side. If the result is "1," the decision is YES, then, in step SP202, the flag intp_startable is set to "1." This flag indicates that interpolation is allowed if the slider 45 is positioned between the first and second scenes.

Since the slider 45 is positioned at the extreme end of the first or second scene, a flag intp is set to "0." This flag specifies execution of interpolation.

If the set flag setflg_1 and the set flag setflg_2 are both "0"s, the decision is NO in step SP201. Then, in step SP203, the processing branches dependently on the slider operational quantity SCSLDOP and the value of the current scene CURRSCENE. The following describes how the branch is made.

Case (1) where the slider operational quantity SCSLDOP is "0" and the current scene CURRSCENE is "1":

If the slider operational quantity SCSLDOP is "0", the processing goes to step SP204. In this step, the flag intp is set to "0." This time, the slider 45 is positioned at the extreme end, so that no interpolation is required. Then, in step SP205, it is determined whether the current scene CURRSCENE is "1" or not. If the decision is YES, the processing goes to step SP206. In this case, the slider 45 is positioned at the side of the selected first scene. In step SP206, the variable i is set to "1" and the same processing operations as those of steps SP12 and SP13 are executed. To be more specific, the contents of the current first scene unique parameter subset SCENEBUF1 are transferred to the scene buffer interpolation parameter SCENEBUFintp, the set flag setflg_1 is set to "1", and the set flag setflg_2 is set to "0." Then, in step SP207, the flag intp_startable is set to "1." In this point, this processing differs from the processing in which steps SP12 and SP13 are simply executed. This processing is intended to enable interpolation next time because the slider 45 is positioned at the extreme end of the selected scene.

Case (2) where the slider operational quantity SCSLDOP is "0" and the current scene CURRSCENE is "2":

If the slider operational quantity SCSLDOP is "0" and the current scene CURRSCENE is "2", then, the decision is NO in step SP205, and the processing goes to step SP208. Such a state indicates that the slider 45 is positioned at the extreme end of the first scene not selected. In step SP208, it is determined whether the flag intp_startable is "1" or not. If the decision is YES, the processing goes to step SP209, in which value "1" is substituted into the variable i and the same processing as that of steps SP12 and SP13 is executed. Namely, if the flag intp_startable is "1," the slider 45 has been moved from the extreme end of the second scene to the other extreme end of the first scene in the interpolation enabled state. To be more specific, the contents of the current first scene unique parameter subset SCENEBUF1 are transferred to the scene buffer interpolation parameter subset SCENEBUFintp, the set flag setflg_1 is set to "1", and the set flag setflg_2 is set to "0." On the other hand, if the flag intp_startable is "0," the decision is NO in step SP208 and the processing returns to the calling routine. Namely, the shift to the first scene is not allowed.

Case (3) where the slider operational quantity is "127" and the current scene CURRSCENE is "2":

If the slider operational quantity is "127", the processing goes to step SP210. The flag intp is set to "0." This is because no interpolation is required since the slider 45 is positioned at the extreme end this time. Then, in step SP211, it is determined whether the current scene CURRSCENE is "2" or not. If the decision is YES, the processing goes to step SP212. In this case, the slider 45 is positioned at the extreme end of the selected second scene. In step SP212, the variable i is set to "2" and the same processing as the processing of steps SP12 and SP13 is executed. To be more specific, the contents of the current second scene unique parameter subset SCENEBUF2 are transferred to the scene buffer interpolation parameter subset SCENEBUFintp, value "0" is set to the set flag setflg_1, and value "1" is set to the set flag setflg_2. Then, in step SP213, the flag intp_startable is set to "1." This is because the same processing as that of the above-mentioned step SP207 is executed.

Case (4) where the slider operational quantity is "127" and the current scene CURRSCENE is "1":

If the slider operational quantity is "127" and the current scene CURRSCENE is "1", then the decision is NO in step SP211 and the processing goes to step SP214. Such a state indicates that the slider 45 is positioned at the extreme end of the second scene not selected. In step SP214, it is determined whether the flag intp_startable is "1" or not. If the decision is YES, the processing goes to step SP215, in which value "2" is substituted into the variable i, and then the same processing as the processing of steps SP12 and SP13 is executed. Namely, if the flag intp_startable is "1," the slider 45 has been shifted from the first scene side to the second scene side in the interpolation enabled state. To be more specific, the contents of the current second scene unique parameter subset SCENEBUF2 are transferred to the scene buffer interpolation parameter subset SCENEBUFintp, the set flag setflg_1 is set to "0", and the set flag setflg_2 is set to "1." On the other hand, if the flag intp_startable is "0," then the decision is NO in step SP214, upon which the processing returns to the calling routine. Namely, the shift to the second scene is not allowed.

Case (5) where the slider operational quantity is between "1" to "126" inclusive:

If the slider operational quantity is between "1" to "126" inclusive, the processing goes to step SP216, in which the value of the flag intp_startable is substituted into the flag intp. That is, in the interpolation enabled state (the flag intp_startable is "1"), interpolation is executed. On the other hand, in an interpolated disabled state (the flag intp_startable is "0"), interpolation is not executed (the flag intp is set to "0").

3.7 Interpolation and Others

Referring to FIG. 7 again, it is determined whether the flag intp is "1" in step SP31. If the decision is NO, the processing returns to the main routine. If the decision is YES, interpolation processing and so on are executed in step SP32 and subsequent steps.

First, in step SP32, calculation of interpolation is performed on numerical parameters according to the slider operational quantity SCSLDOP. Now, if a numerical parameter group in the current first scene unique parameter subset SCENEBUF1 is expressed in nd(SCENEBUF1), another numeral parameter group in the current second scene unique parameter subset SCENEBUF2 is expressed in nd(SCENEBUF2), and a numerical parameter group resulted from the interpolation between the foregoing two groups is expressed in nd(SCENEBUFintp), then the nd(SCENEBUFintp) is generally expressed as follows:

$$nd(\text{SCENEBUFintp})=f(\text{SCSLDOP}, nd(\text{SCENEBUF1}), nd(\text{SCENEBUF2})) \quad (1)$$

In a typical example, function f is a linear interpolation function, which is expressed as follows with SCSLDOPmax being a maximum value (127) of the slider operational quantity SCSLDOP:

$$f(SCSLDOP, nd(SCENEBUF1), nd(SCENEBUF2)) = \{(SCSLDOPmax - SCSLDOP) * nd(SCENEBUF1) + SCSLDOP * nd(SCENEBUF2)\} / SCSLDOPmax \quad (2)$$

where $0 \leqq \text{SCSLDOP} \geqq \text{SCSLDOPmax}$

Next, in step SP33, it is determined whether the calculation of interpolation has been performed on all numerical parameters. If the decision is NO, the processing returns to step SP32, in which the same processing is executed for all remaining numerical parameters. When the calculation of interpolation has been completed on all numerical parameters, the processing goes to step SP34.

In step SP34, setting processing is performed on Boolean parameters (a group of the Boolean parameters is expressed by sd(name of corresponding timbre scene). This setting processing is generally expressed as follows like equation (1) above:

$$sd(\text{SCENEBUFintp})=f(\text{SCSLDOP}, sd(\text{SCENEBUF1}), sd(\text{SCENEBUT2})) \quad (3)$$

Since the Boolean parameters are used for setting a discrete state, typical examples are expressed as follows:

$$sd(SCENEBUFintp) = f(SCSLOP, sd(SCENEBUF1), sd(SCENEBUF2)) \quad (4)$$

-continued $$= f(0, sd(SCENEBUF1), sd(SCENEBUF2)) = sd(SCENEBUF1)$$

where (SCSLDOP=0).

$$sd(SCENEBUTintrp) = f(SCSLDOP, sd(SCENEBUF1), sd(SCENEBUF2)) = f(SCSLDOPmax, sd(SCENEBUF1), sd(SCENEBUF2)) = sd(SCENEBUF2) \quad (5)$$

where (SCSLDOP=SCSLDOPmax).

$$sd(\text{SCENEBUFintp})=(\text{last } sd(\text{SCENEBUFintp})) \quad (6)$$

where (0<SCSLDOP<SCSLDOPmax).

In the above-mentioned expressions (4) through (6), when the slider operational quantity SCSLDOP reaches "0", the timbre parameters of the current first scene unique parameter subset SCENEBUF1 are set to the timbre parameters of the scene buffer interpolation parameter subset SCENEBUFintp. On the other hand, when the slider operational quantity SCSLDOP reaches "127", the timbre parameters of the current second scene unique parameter subset SCENEBUF2 are set to the timbre parameters of the scene buffer interpolation parameter subset SCENEBUFintp. When the slider operational quantity SCSLDOP is between "1" to "126" inclusive, the scene buffer interpolation parameter subset SCENEBUFintp remains unchanged. To be more specific, when the slider operational quantity SCSLDOP is between "1" and "126" inclusive, the Boolean parameter used when the slider operational quantity has reached "0" or "127" is used, so that hysteresis characteristic can be imparted to the slider 45.

It should be noted that a threshold for the slider operational quantity may be set. If the threshold is greater than the slider operational quantity SCSLDOP, the current first scene unique parameter subset SCENEBUF1 may be selected. If the threshold is equal to or smaller than the slider operational quantity SCSLDOP, the current second scene unique parameter subset SCENEBUF2 may be selected. If there are three or more Boolean parameter setting states, plural thresholds may be defined to set the Boolean value of the timbre parameter based on which range the slider operational quantity SCSLDOP belongs to. Which of the methods is to be used may be determined according to the type of the timbre parameters.

Then, in step SP35, it is determined whether the above-mentioned setting processing has been executed for all Boolean parameters. If the decision is NO, the processing returns to step SP34, and the same processing is performed on the remaining Boolean parameters. When the setting processing has been completed for all Boolean parameters, the processing returns to the main routine.

As described, according to the present preferred embodiment of the invention, interpolation can be performed by operating the slider 45, and the first and second scenes can be selected in a single operation by the first and second scene select switches 41 and 43, thereby significantly enhancing the operating efficiency of the electronic musical instrument associated with the invention.

3.8; Key-on Event Processing

Figure 8:
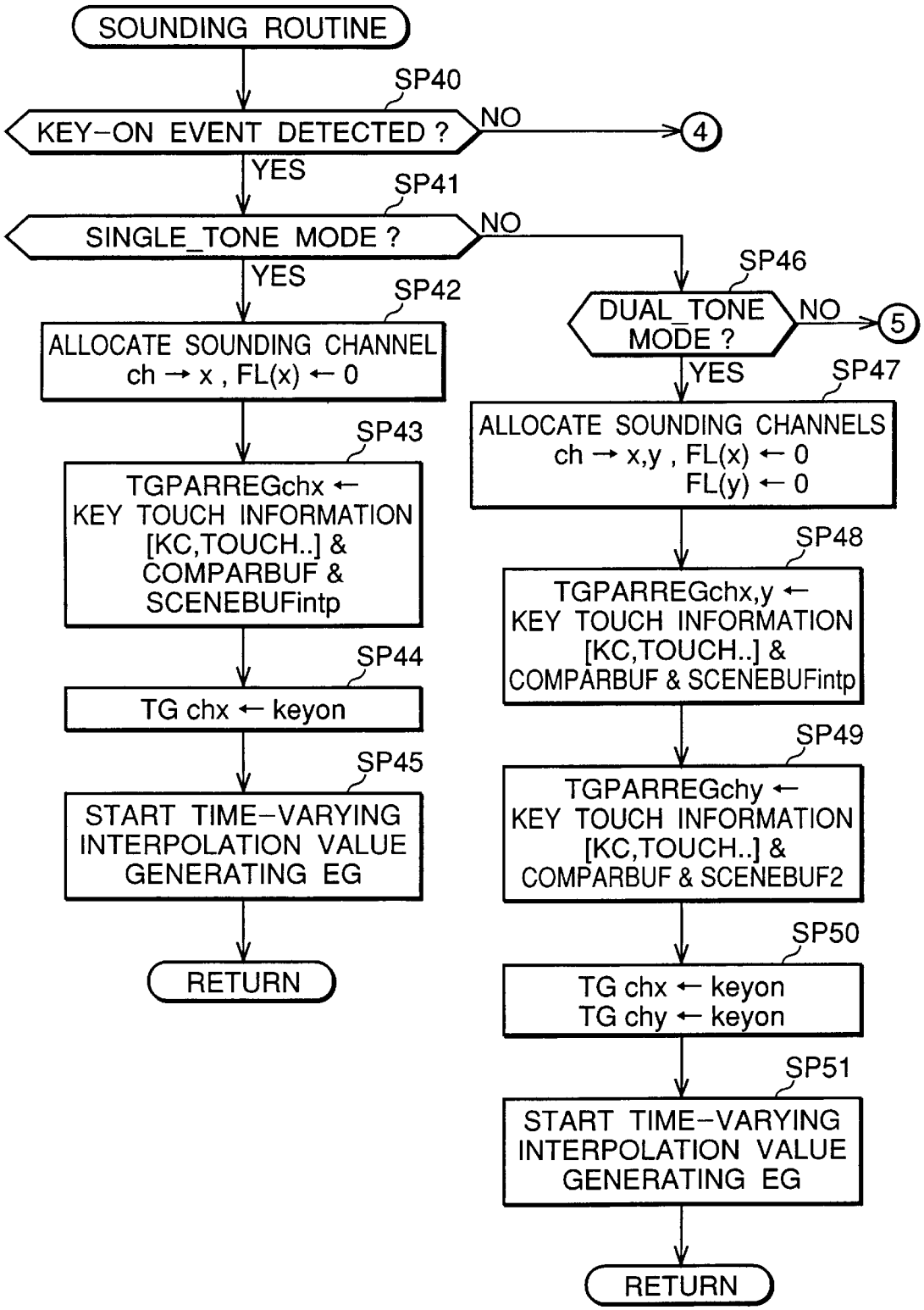
FIG. 8 is a flowchart of another subroutine executed in the above-mentioned preferred embodiment.
Figure 9:
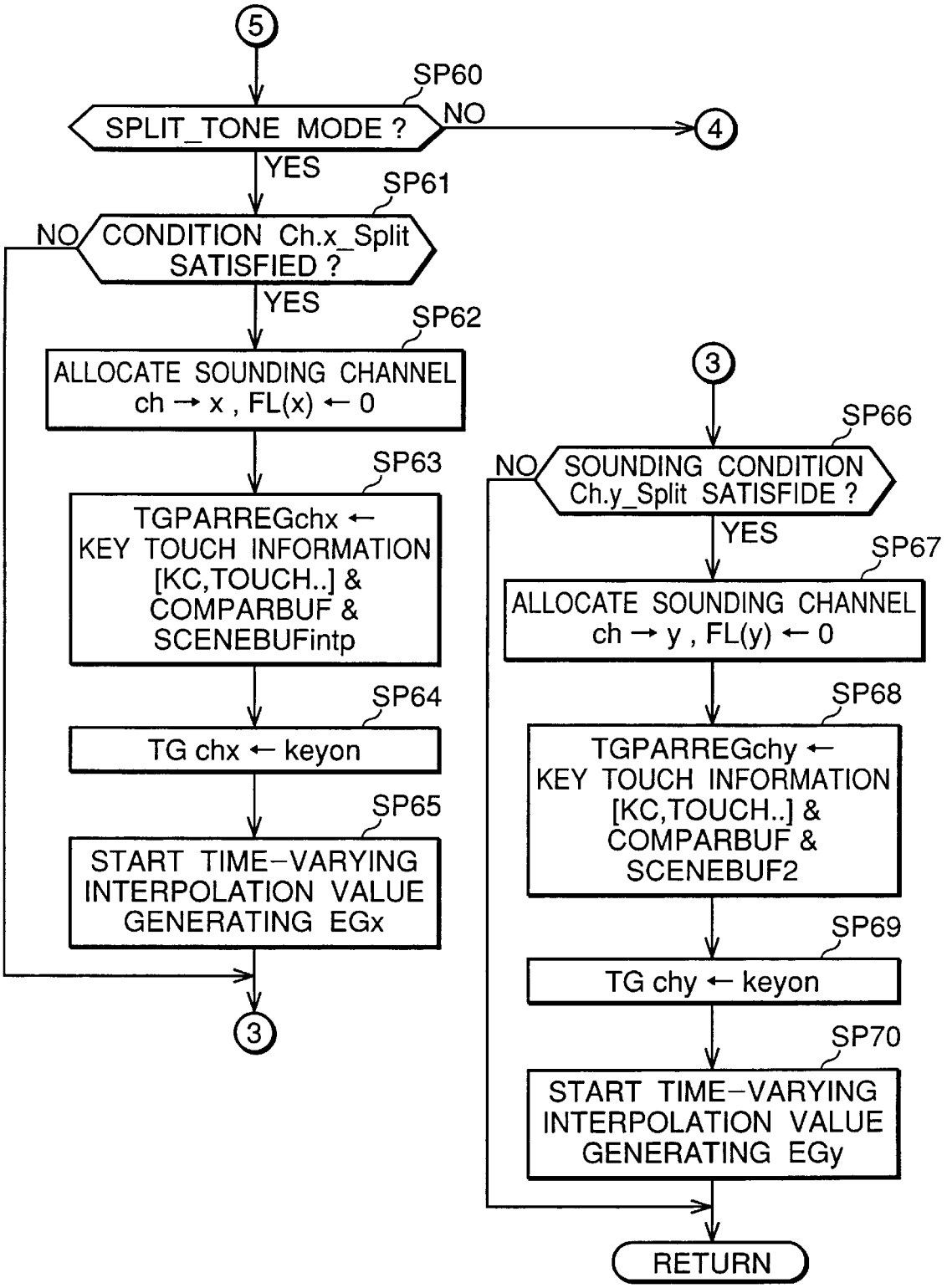
FIG. 9 is another flowchart of the above-mentioned subroutine.
Figure 10:
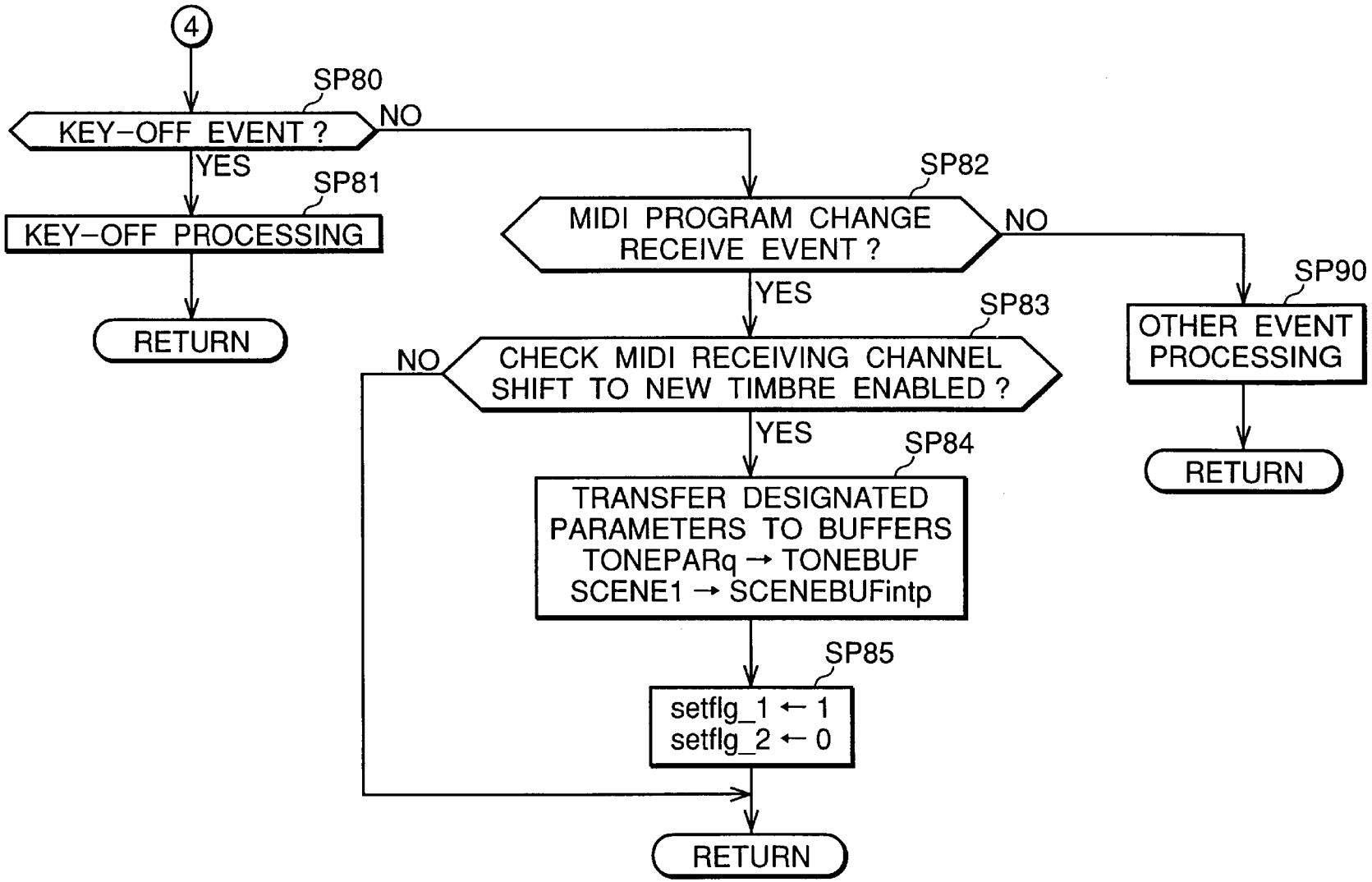
FIG. 10 is still another flowchart of the above-mentioned subroutine.

When the processing goes to step SP104 in the main routine, subroutines shown in FIGS. 8 through 10 are called.

When the processing goes to step SP40 in FIG. 8, it is determined whether a key-on event has been detected in step SP102. The key-on event denotes not only a key-on event caused by operating the music play keyboard 7 but also a note-on event of a MIDI signal supplied via the network interface 5 or the serial interface 6.

3.8.1 Single Mode

If the key-on event has been detected, then, in step SP41, it is determined whether the operating mode is the single mode. If the decision is YES, then, in step SP42, sounding channel allocating processing is executed. To be specific, the tone generator 9 is searched for a vacant channel to allocate one vacant channel to the key-on event concerned. If no vacant channel is found, a channel in release state is forcibly discontinued and allocated to the key-on event. Here, let the allocated channel number be x. Among flags FL(1) through FL(j) (j being the number of channels) provided for the channels in the tone generator, the flag FL(x) is set to "0." It should be noted that the flags FL(1) through FL(j) indicate whether the numerical parameters in the TG parameter registers TGPARREGch1 through TGPARREGchj can be changed based on the scene buffer interpolation parameter SCENEBUFintp. If the flag FL is "0," the numerical parameter can be changed; if it is "1," the numerical parameter cannot be changed. In the present embodiment, the timbre of a sounding channel is altered according to the operation of the slider 45, so that the flag FL(x) for a newly allocated channel is set to "0."

Then, in step SP43, a TG parameter register TGPARREGchx of channel number x in the tone generator 9 is set. To be specific, the TG parameter is calculated based on key-on information including a key code and a touch velocity, the current common parameter COMPARBUF, and the scene buffer interpolation parameter SCENEBUFintp. The calculation result is stored in the channel concerned of the TG parameter register 91. Then, in step SP44, a key-on signal is supplied to the channel number x of the tone generator 9. This starts sounding processing in the channel number x in the tone generator 9.

In step SP45, the operation of time-varying interpolation value generating EG is started as required. The time-varying interpolation value generating EG denotes a program for generating a value similar to the slider operational quantity SCSLDOP as time varies. Namely, a time-varying interpolation value EG_intp is generated as the time elapses from the start. When this program is in the active state, a routine for detecting the operational quantity of the slider 45 is fetched in step SP102 to substitute the time-varying interpolation value EG_intp into the slider operational quantity SCSLDOP. This automates movement between the scenes even if the user does not actually operate the slider 45. Whether to operate the time-varying interpolation value generating EG or not can be determined by the user. If the user disables the EG, no substantial processing is executed in step SP45. When the above-mentioned processing operations have been completed, the processing returns to the main routine.

3.8.2 Dual Mode

If the operating mode active at detection of a key-on event is not the single mode, then, in step SP41, the decision is NO and the processing goes to step SP46. In this step, it is determined whether the operating mode is the dual mode. If the decision is YES, then, in step SP47, the sounding channel allocating processing is executed. Namely, the tone generator 9 is searched for vacant channels, and two vacant channels are allocated to one key-on event concerned. If no vacant channel is found as described with reference to step SP42, channels in the release state are forcibly discontinued and allocated to the key-on event concerned. Here, let the allocated channel numbers be x and y. Here again, flags FL(x) and FL(y) are set to "0"s.

Then, in step SP48, the TG parameter register TGPARREGchx for the channel number x is set. This setting processing is the same as that of the above-mentioned step S43. Next, in step SP49, the TG parameter register TGPARREGchy is set. This setting processing is generally the same as the processing of steps SP43 and SP48. A difference lies in that, in step SP49, the current second scene unique parameter SCENEBUF2 is used instead of the scene buffer interpolation parameter SCENEBUFintp. In step SP50, a key-on signal is concurrently supplied to the channels x and y in the tone generator 9, starting sounding of a dual tone. When the processing goes to step SP51, the time-varying interpolation value generating EG is started as required.

This dual mode operation is also one of the features of the present preferred embodiment of the invention. To be specific, if completely different parameters are set to the current first scene unique parameter SCENEBUF1 and the current second scene unique parameter SCENEBUF2 and further the current first scene unique parameter SCENEBUF1 is used for the scene buffer interpolation parameter SCENEBUFintp, a duet of completely different two timbres is performed. If the user operates the slider 45 or starts the time-varying interpolation value generating EG, the content of the scene buffer interpolation parameter SCENEBUFintp gradually approaches to or moves away from the current second unique parameter SCENEBUF2. This is an effect which cannot be obtained by any means on the conventional electronic musical instruments. This dual mode operation provides more versatile music play expression than conventionally available. Especially, if the time-varying interpolation value generating EG is used, a profile of the time-varying interpolation value EG_intp can be set to various waveforms such as sine curve and triangle, thereby providing interesting music tones without requiring the user to perform special operation.

3.8.3 Split Mode

If the operating mode in which a key-on event has been detected is neither the signal mode nor the dual mode, then the decision is NO in steps SP41 and SP46. Then, the processing goes to step SP60. In this step, it is determined whether the operating mode is the split mode. If the decision is YES, the processing goes to step SP61. As described before, in the split mode, one of plural types of timbres is selected according to a selected key range or a key touch velocity. In the present embodiment, if a predetermined condition (Ch.x_Split) is satisfied, a timbre is set based on the scene buffer interpolation parameter SCENEBUFintp; if another condition (Ch.y_Split) is satisfied, a timbre is set based on the current second scene unique parameter SCENEBUF2.

In step SP61, it is determined whether the condition Ch.x_split has been satisfied. If the decision is YES, the processing of steps SP62 through SP65 is executed. The nature of this processing is the same as that of the processing of steps SP42 through SP45. Next, the processing goes to step SP66 regardless of whether that condition has been satisfied, and it is determined whether the other condition Ch.y_Split has been satisfied.

If the decision is YES, the processing of steps SP67 through SP70 is executed. The nature of this processing is generally the same as that of the processing of steps SP42 through SP45 except that the current second scene unique parameter SCENEBUF2 is used instead of the scene buffer interpolation parameter SCNEBUFintp. It should be noted that the conditions Ch.x_Split and Ch.y_Split may be satisfied at the same time. In such a case, a duet music tone is sounded like the dual mode. When the sounding processing according to the operating mode has been completed, the processing goes to the main routine.

3.9 Key-off Event Processing

If no key-on event has been detected in step SP40 shown in FIG. 8, the processing goes to step SP80 shown in FIG. 10. In this step, it is determined whether a key-off event has been detected in step SP102 shown in FIG. 4. If the decision is YES, the processing goes to step SP81, in which key-off processing is executed. Namely, a key-off signal is supplied to the channel concerned in the tone generator 9 and release processing is performed in that channel. Then, the processing returns to the main routine.

3.10 Processing for MIDI Program Change Signal and Others

If no key-off event has been detected, the decision is NO in step SP80 and the processing goes to step SP82. In this step, it is determined whether an event of MIDI program change signal has been detected in step SP102 shown in FIG. 4. If the decision is YES, the processing goes to step SP83, in which it is determined whether shift to a new timbre set has been instructed by this MIDI program change signal. If the decision is NO, then the processing returns to the main routine. Namely, even if the MIDI program change signal is supplied, no substantial processing is executed if the same timbre set as that currently sounded is designated. On the other hand, if the decision is YES in step SP83, the processing of steps SP84 and SP85 is executed. This processing is the same as that of steps SP12 and SP13 shown in FIG. 6. In this processing, the newly selected timbre set TONEPARq is transferred to the tone buffer area 202 and its first scene unique parameter subset SCENE1 is transferred to the interpolated data area 203 as the new scene buffer interpolation parameter subset SCENEBUFintp. Further, value "1" is substituted into the current scene CURRSCENE, value "1" is set to the set flag setflg_1, and value "0" is set to the set flag setflg_2. When the above-mentioned processing operations have been completed, the processing returns to the main routine. If the decision is NO in step SP82, then, in step SP90, other event processing is executed. Thereafter, the processing returns to the main routine.

3.11 Timbre Control Processing

Figure 11:
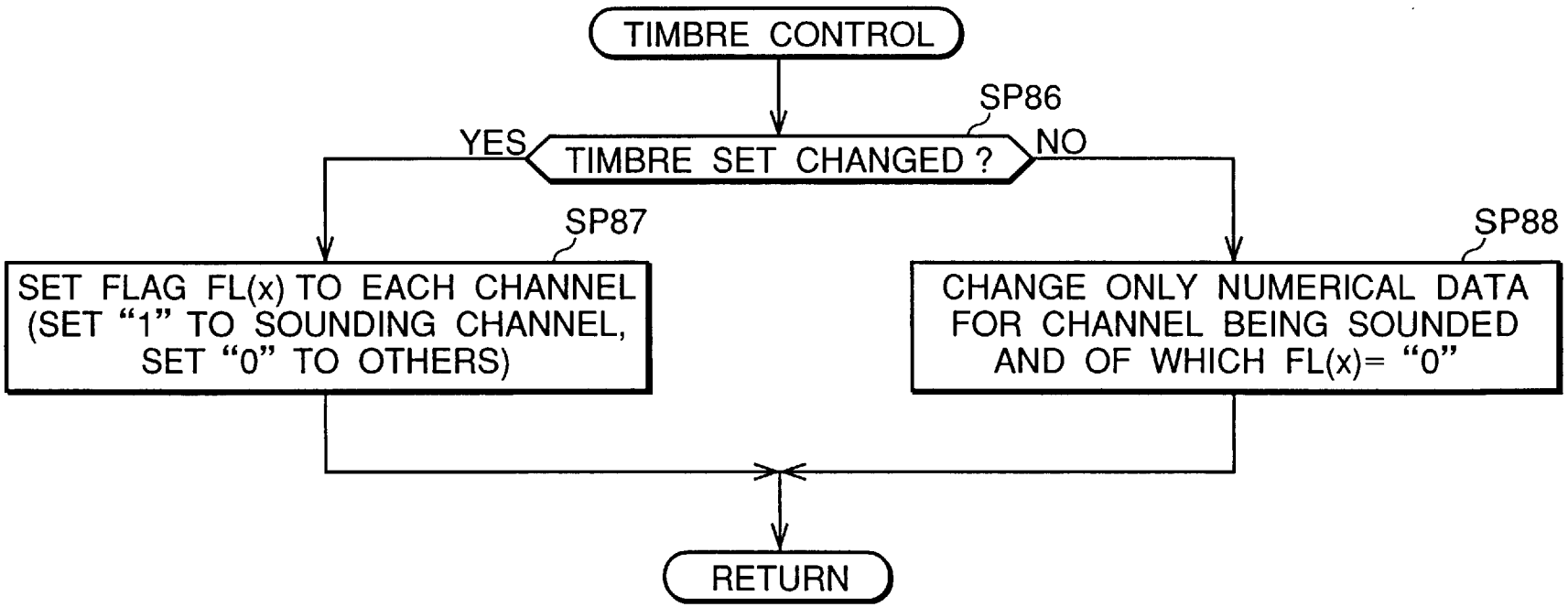
FIG. 11 is a flowchart of still another subroutine of the above-mentioned preferred embodiment.

When the processing goes to step SP105 in the main routine shown in FIG. 4, a subroutine shown in FIG. 11 is called. When the processing goes to step SP86 shown in FIG. 11, it is determined whether change of the timbre set has taken place in the main loop (namely, whether step SP12 and SP13 or steps SP84 and SP85 have been executed).

If the decision is NO, the processing goes to step SP88. In this step, for channel x currently sounded, of which flag FL(x) (x=1, . . . , j) is "0," the numerical parameters in the TG parameter register TGPARREGchx are changed. To be more specific, the numerical parameters are changed according to the current values of the scene buffer interpolation parameters SCENEBUFintp, but no Boolean parameter is changed.

On the other hand, if the timbre set has been changed, the processing goes to step SP87, in which, for the currently sounded channel, the flag FL(x) is set to "1" and, for other channels, the flag FL(x) is set to "0." When the above-mentioned processing operations have been completed, the processing returns to the main routine.

It should be noted that, even if the processing of step SP88 has been executed, the numerical parameters in the TG parameter registers TGPARREGchl through TGPARREGchj are not immediately changed to those compatible with the contents of the scene buffer interpolation parameter subset SCENEBUFintp. This is intended to prevent a noise from being generated or to prevent a music tone from getting unnatural. To be more specific, each numerical parameter is changed such that the same approaches a value compatible with the scene buffer interpolation parameter SCENEBUFintp in a range below a predetermined maximum value (for example, 4) every time the processing of step SP88 is executed. In this case, if the value of the numerical parameter needs to be changed from "0" to "127", this is achieved by executing the main loop 32 times.

The following describes the significance of steps SP87 and SP88 by assuming a specific example. First, it is assumed that the timbre set "piano" and its first scene (first subset) are selected, while the operating mode is the single mode. When a key-on event is caused in this state, a channel (the first channel for example) of the tone generator 9 is allocated to the detected key-on event, and the music tone of the first scene of the timbre set "piano" starts sounding.

When the user manipulates or positions the slider 45 to the extreme end of the first scene side, the flag intp_startable goes "1" to enable calculation for interpolation. Then, when the user moves the slider 45 toward the second scene side, the value of the scene buffer interpolation parameter SCENEBUFintp gradually approaches the value of the current second scene unique parameter SCENEBUF2. In this process, the processing of step SP88 is executed in every cycle of the main loop, so that the numerical parameters of the TG parameters of the first channel approach to those of the second scene, thereby changing the timbre of the music tone to be sounded.

If the slider 45 has been moved fully to the extreme end of the second scene side or an event of the second scene select switch 43 has occurred, the value of the scene buffer interpolation parameter SCENEBUFintp is made equal to the value of the current second scene unique parameter SCENEBUF2. However, only the numerical parameters have been changed in step SP88, so that the music tone of the first channel approaches the music tone of the second scene but does not become the same.

If another new key-on event occurs here, another new channel (for example, the second channel) is allocated to the newly detected key-on event. Because a music tone associated with the second channel is set according to the scene buffer interpolation parameter SCENEBUFintp at the time of channel allocation (refer to step SP43), the music tone of the second channel is sounded completely based on the timbre parameter of the second scene. This is one of the features of the present preferred embodiment. To be more specific, to the event newly caused after scene setting, a timbre parameter completely suited to that scene is set, while the result of the scene setting can be mostly (namely, except for Boolean parameters) reflected to the channel associated with that event.

If a timbre select event (here it is assumed that the timbre set "cembalo" is selected) occurs during sounding of the first and second channels, steps SP12 and SP13 or steps SP84 and SP85 are executed to set the scene buffer interpolation parameter SCENEBUFintp according to the newly selected timbre set and its first scene. If the processing of step SP86 is executed in the cycle of the main loop in which this timbre select event has been detected, the decision is YES and the processing of step SP87 is executed, so that flags FL(1) and FL(2) are both set to "1"s. Consequently, even if the processing of step SP88 is executed thereafter, the first and second channels continue to sound based on the timbre parameter (TG parameter) associated with piano. This prevents the music tones of the first and second channels from being affected by the later events of the first and second scene select switches 41 and 43 and the slider 45.

Needless to add, the sounding processing based on the timbre parameter of cembalo is executed for an event caused after the timbre select event, and the timbre is controlled according to the events of the first and second scene select switches 41 and 43 and the slider 45. Thus, according to the present preferred embodiment, the channels to be affected and not to be affected by the scene buffer interpolation parameter SCENEBUFintp can be distinguished by the flags FL(1) through FL(j). Therefore, when the timbre set has been changed, scene setting can be made without affecting the music tone associated with the existing event.

3.12 Interpolation Value EG Processing

Back to the main routine shown in FIG. 4, the processing goes to step SP106, in which interpolation value EG processing is executed. To be more specific, if the operation of time-varying interpolation value generating EG starts in step SP45, the time-varying interpolation value EG_intp is calculated according to the elapsed time after the start.

4. Variations

The present invention is not limited to the above-mentioned preferred embodiment but allows the following variations for example.

4.1 In the above-mentioned preferred embodiment, the tone generator 9 is realized as a hardware device connected to the bus 12. It will be apparent to those skilled in the art that the tone generator 9 can also be realized as a software module that operates on the CPU 1. In this case, a music tone signal is directly supplied to the DA converter 10 over the bus 12.

4.2 The above-mentioned embodied apparatus is realized as an electronic musical instrument. It will be apparent that the present invention is also applicable to amusement apparatuses such as a game machine and a karaoke machine, household electrical appliances such as a television receiver, computers such as a personal computer, and a system in which these machines and appliances are integrated.

4.3 In the above-mentioned preferred embodiment, the timbre parameters are stored in the ROM 3 and so on. It will be apparent that the timbre data can be supplied in a recording medium that is set on the auxiliary storage device 4 or in a timber data library provided on a network device connected to the network interface 5.

4.4 In the above-mentioned preferred embodiment, when the slider 45 has been moved fully to the extreme end of the first or second scene side, the scene buffer interpolation parameter SCENEBUFintp is set such that all the contents thereof are made equal to the current first scene unique parameter SCENEBUF1 or the current second scene unique parameter SCENEBUF2. It will be apparent that only the numerical parameters in the scene buffer interpolation parameter subset SCENEBUFintp can be set to those of the current first scene unique parameter subset SCENEBUF1 or the current second scene unique parameter subset SCENEBUF2. Namely, the Boolean parameters can be kept unchanged to the operation of the slider 45, while they are changed only by the events of the first and second scene select switches 41 and 43.

4.5 In the above-mentioned preferred embodiment, the slider 45 is used for the interpolation control. It will be apparent that the specifications and forms of this control are not limited to that of the above-mentioned preferred embodiment; for example, a rotary knob, a pressure-sensitive switch, or a pedal-operated switch may be used. Alternatively, interpolation may be controlled based on the operation state of the first and second scene select switches 41 an 43. For example, interpolation can be made in the direction of the scene corresponding to the successively hit first or second scene select switch 41 or 43 according to the number of successive hits or a time interval between the successive hits.

As described above, the inventive parameter setting apparatus is provided in the electronic music instrument for editing a set of parameters in accordance with a manipulation amount to set the tone generator 9 which creates a desired timbre of musical tones upon setting. In the inventive apparatus, a first memory device composed of RAM 2 stores a first subset of parameters containing a Boolean parameter having a first Boolean value and a numerical parameter having a first numerical value. A second memory device composed also of RAM 2 stores a second subset of parameters containing the Boolean parameter having a second Boolean value and the numerical parameter having a second numerical value. An operating device composed of the slider 45 provides a manipulation amount for editing parameters. An interpolating device functionally provided by means of CPU 1 interpolates the first numerical value and the second numerical value in accordance with the manipulation amount to determine an edited numerical value of the numerical parameter. A selecting device also functionally provided by CPU 1 selects one of the first Boolean value and the second Boolean value in accordance with the manipulation amount to determine an edited Boolean value of the Boolean parameter. A setting device further provided by CPU 1 sets the tone generator 9 with the set of parameters containing the numerical parameter having the edited numerical value and the Boolean parameter having the edited Boolean value.

The inventive apparatus further includes an additional operating device composed of the switches 41 and 43 that can be manipulated to default the operating device while designating one of the first subset and the second subset so that the setting device sets the tone generator 9 with the designated one of the first subset and the second subset without regard to the manipulation amount.

Preferably, the operating device comprises a manual operating device such as the slider 45 that manually inputs the manipulation amount ranging from one extreme level to another extreme level through a variable intermediate level so that the interpolating device variably interpolates the first numerical value and the second numerical value according to the variable intermediate level of the inputted manipulation amount. In such a case, the selecting device comprises an alternate selecting device that switches one of the first and second Boolean values to the other of the first and second Boolean values when the inputted manipulation amount changes from said one extreme level to said another extreme level. Otherwise, the selecting device comprises an alternate selecting device that selects one of the first and second Boolean values when the inputted manipulation amount is lower than a predetermined intermediate level or threshold and that selects the other of the first and second Boolean values when the inputted manipulation amount exceeds the predetermined intermediate level.

In modification, the operating device comprises an automatic operating device that automatically provides a variable manipulation amount under control of an instruction program so that the tone generator 9 creates a variable timbre of musical tones according to the instruction program.

In another aspect, the inventive parameter setting apparatus edits a set of parameters in accordance with a manipulation amount to set the tone generator which creates a desired timbre of musical tones upon setting. In the inventive apparatus, a first memory device stores a first subset of parameters. A second memory device stores a second subset of parameters, which is a different version of the first subset. An operating device such as the slider 45 provides a manipulation amount for editing the parameters. An interpolating device interpolates the parameters between the first subset and the second subset in accordance with the manipulation amount to determine an edited subset of the parameters. An additional operating device such as the switches 41 and 43 can be actuated to designate one of the first subset and the second subset to determine a default subset of the parameters. A setting device sets the tone generator 9 with the set of the parameters containing the edited subset, and otherwise sets the tone generator 9 with the set of the parameters containing the default subset regardless of the manipulation amount when the additional operating device is actuated.

The present invention further covers the machine readable medium 15 used in the music machine having the CPU 1 for setting a desired timbre of musical tones by timbre parameters. The medium 15 contains program instructions executable by the CPU 1 to perform the steps of provisionally providing the timbre parameters of a first scene which contains a Boolean timbre parameter having a first Boolean value and a numerical timbre parameter having a first numerical value, provisionally providing the timbre parameters of a second scene which is a different version of the first scene and which contains the Boolean timbre parameter having a second Boolean value and the numerical timbre parameter having a second numerical value, providing a manipulation amount to edit the timbre parameters, interpolating the first numerical value and the second numerical value in accordance with the manipulation amount to determine an edited numerical value of the numerical timbre parameter, selecting one of the first Boolean value and the second Boolean value in accordance with the manipulation amount to determine an edited Boolean value of the Boolean timbre parameter, and setting the desired timbre of the musical tones by the timbre parameters of an edited scene which contains the numerical timbre parameter having the edited numerical value and the Boolean timbre parameter having the edited Boolean value.

Otherwise, the machine readable medium 15 contains program instructions executable by the CPU 1 to perform the steps of provisionally providing the timbre parameters of a first scene, provisionally providing the timbre parameters of a second scene which is a different version of the first scene, providing a manipulation amount for editing the timbre parameters, interpolating the timbre parameters between the first scene and the second scene in accordance with the manipulation amount to create an edited scene of the timbre parameters, optionally designating one of the first scene and the second scene as a default scene of the timbre parameters, setting the desired timbre of the musical tones by the timbre parameters of the edited scene, and alternatively setting a default timbre of the musical tones by the timbre parameters of the default scene regardless of the manipulation amount when the default scene is optionally designated.

As described and according to the present invention, timbre parameters composed of a numerical parameter interpolated by the interpolating means and a Boolean parameter set by the Boolean parameter setting means are outputted. This novel constitution allows a timbre to smoothly shift even accompanied by fluctuation due to a Boolean parameter, thereby providing versatile musical expression. Further, according to the present invention, the timbre parameters of the first and second scenes are interpolated according to the operational quantity of the operating device and the interpolated parameters are outputted. Meanwhile, when the selecting means is operated, the timbre parameter associated with the selected scene is outputted regardless of the operational quantity. This novel constitution significantly enhances the operational efficiency of the electronic musical instrument associated with the present invention.

While the preferred embodiments of the present invention have been described using specific terms, such description is for illustrative purposes only, and it is to be understood that changes and variations may be made without departing from the spirit or scope of the appended claims.

What is claimed is:

1. An apparatus for editing a set of parameters in accordance with a manipulation amount to set a tone generator which creates a desired timbre of musical tones upon setting, the apparatus comprising:

a first memory device that stores a first subset of parameters containing a Boolean parameter having a first Boolean value and a numerical parameter having a first numerical value;

a second memory device that stores a second subset of parameters containing the Boolean parameter having a second Boolean value and the numerical parameter having a second numerical value;

an operating device that provides a manipulation amount for editing parameters;

an interpolating device that interpolates the first numerical value and the second numerical value in accordance with the manipulation amount to determine an edited numerical value of the numerical parameter;

a selecting device that selects one of the first Boolean value and the second Boolean value in accordance with the manipulation amount to determine an edited Boolean value of the Boolean parameter; and a setting device that sets the tone generator with the set of parameters containing the numerical parameter having the edited numerical value and the Boolean parameter having the edited Boolean value.

2. An apparatus according to claim 1, further comprising an additional operating device that can be manipulated to default the operating device while designating one of the first subset and the second subset so that the setting device sets the tone generator with the designated one of the first subset and the second subset without regard to the manipulation amount.

3. An apparatus according to claim 1, wherein the operating device comprises a manual operating device that manually inputs the manipulation amount ranging from one extreme level to another extreme level through a variable intermediate level so that the interpolating device variably interpolates the first numerical value and the second numerical value according to the variable intermediate level of the inputted manipulation amount.

4. An apparatus according to claim 2, wherein the selecting device comprises an alternate selecting device that switches one of the first and second Boolean values to the other of the first and second Boolean values when the inputted manipulation amount changes from said one extreme level to said another extreme level.

5. An apparatus according to claim 2, wherein the selecting device comprises an alternate selecting device that selects one of the first and second Boolean values when the inputted manipulation amount is lower than a predetermined intermediate level and that selects the other of the first and second Boolean values when the inputted manipulation amount exceeds the predetermined intermediate level.

6. An apparatus according to claim 1, wherein the operating device comprises an automatic operating device that automatically provides a variable manipulation amount under control of an instruction program so that the tone generator creates a variable timbre of musical tones according to the instruction program.

7. An apparatus for editing a set of parameters in accordance with a manipulation amount to set a tone generator which creates a desired timbre of musical tones upon setting, the apparatus comprising:

a first memory device that stores a first subset of parameters;

a second memory device that stores a second subset of parameters, which is a different version of the first subset;

an operating device that provides a manipulation amount for editing the parameters;

an interpolating device that interpolates the parameters between the first subset and the second subset in accordance with the manipulation amount to determine an edited subset of the parameters;

an additional operating device that can be actuated to select one of the first subset and the second subset to determine a default subset of the parameters; and a setting device that sets the tone generator with the set of the parameters containing the edited subset and that otherwise sets the tone generator with the set of the parameters containing the default subset regardless of the manipulation amount as an override when the additional operating device is actuated.

8. A music apparatus comprising:

generating means set by timbre parameters to generate musical tones having a desired timbre;

first memory means storing the timbre parameters of a first situation which contains a Boolean timbre parameter having a first Boolean value and a numerical timbre parameter having a first numerical value;

second memory means storing the timbre parameters of a second situation which is a different version of the first situation and which contains the Boolean timbre parameter having a second Boolean value and the numerical timbre parameter having a second numerical value;

operating means for inputting a manipulation amount to edit the timbre parameters;

interpolating means for interpolating the first numerical value and the second numerical value in accordance with the manipulation amount to determine an edited numerical value of the numerical timbre parameter;

selecting means for selecting one of the first Boolean value and the second Boolean value in accordance with the manipulation amount to determine an edited Boolean value of the Boolean timbre parameter; and setting means for setting the generating means with the timbre parameters of an edited situation which contains the numerical timbre parameter having the edited numerical value and the Boolean timbre parameter having the edited Boolean value.

9. A music apparatus according to claim 8, wherein the setting means comprises dual setting means for setting one channel of the generating means with the timbre parameters of the edited situation, and for setting another channel of the generating means with the timbre parameters of either the first situation and the second situation so that the generating means can concurrently generate musical tones having different desired timbres.

10. A music apparatus according to claim 8, further comprising playing means for inputting performance information to control the generating means to generate musical tones, and wherein the setting means comprises split setting means for selectively setting the generating means with the timbre parameters of the edited situation, the first situation and the second situation according to the inputted performance information.

11. A music apparatus:

generating means set by timbre parameters to generate musical tones having a desired timbre;

first memory means storing the timbre parameters of a first situation;

second memory means storing the timbre parameters of a second situation which is a different version of the first situation;

edit operating means for inputting a manipulation amount to edit the timbre parameters;

interpolating means for interpolating the timbre parameters between the first situation and the second situation in accordance with the manipulation amount to create an edited situation of the timbre parameters;

default operating means optionally actuated to select one of the first situation and the second situation as a default situation of the timbre parameters; and setting means for setting the generating means with the timbre parameters of the edited situation and otherwise for setting the generating means with the timbre parameters of the default situation regardless of the manipulation amount as an override when the default operating means is optionally actuated.

12. A method of configuring a tone generator by timbre parameters to generate musical tones having a desired timbre, the method comprising the steps of:

provisionally providing the timbre parameters of a first situation which contains a Boolean timbre parameter having a first Boolean value and a numerical timbre parameter having a first numerical value;

provisionally providing the timbre parameters of a second situation which is a different version of the first situation and which contains the Boolean timbre parameter having a second Boolean value and the numerical timbre parameter having a second numerical value;

providing a manipulation amount to edit the timbre parameters;

interpolating the first numerical value and the second numerical value in accordance with the manipulation amount to determine an edited numerical value of the numerical timbre parameter;

selecting one of the first Boolean value and the second Boolean value in accordance with the manipulation amount to determine an edited Boolean value of the Boolean timbre parameter; and configuring the tone generator by the timbre parameters of an edited situation which contains the numerical timbre parameter having the edited numerical value and the Boolean timbre parameter having the edited Boolean value so that the tone generator can generate the musical tones having the desired timbre which is characterized by the edited situation and which is different than those characterized by the first and second situations.

13. A method of configuring a tone generator by timbre parameters to generate musical tones having a desired timbre, the method comprising the steps of:

provisionally providing the timbre parameters of a first situation;

provisionally providing the timbre parameters of a second situation which is a different version of the first situation;

providing a manipulation amount for editing the timbre parameters;

interpolating the timbre parameters between the first situation and the second situation in accordance with the manipulation amount to create an edited situation of the timbre parameters;

optionally selecting one of the first situation and the second situation as a default situation of the timbre parameters; and configuring the tone generator by the timbre parameters of the edited situation; and alternatively configuring the tone generator by the timbre parameters of the default situation regardless of the manipulation amount as an override when the default situation is optionally designated.

14. A machine readable medium used in a music machine having a CPU for setting a desired timbre of musical tones by timbre parameters, the medium containing program instructions executable by the CPU to perform the steps of:

provisionally providing the timbre parameters of a first situation which contains a Boolean timbre parameter having a first Boolean value and a numerical timbre parameter having a first numerical value;

provisionally providing the timbre parameters of a second situation which is a different version of the first situation and which contains the Boolean timbre parameter having a second Boolean value and the numerical timbre parameter having a second numerical value;

providing a manipulation amount to edit the timbre parameters;

interpolating the first numerical value and the second numerical value in accordance with the manipulation amount to determine an edited numerical value of the numerical timbre parameter;

selecting one of the first Boolean value and the second Boolean value in accordance with the manipulation amount to determine an edited Boolean value of the Boolean timbre parameter; and setting the desired timbre of the musical tones by the timbre parameters of an edited situation which contains the numerical timbre parameter having the edited numerical value and the Boolean timbre parameter having the edited Boolean value.

15. A machine readable medium used in a music machine having a CPU for setting a desired timbre of musical tones by timbre parameters, the medium containing program instructions executable by the CPU to perform the steps of provisionally providing the timbre parameters of a first situation;

provisionally providing the timbre parameters of a second situation which is a different version of the first situation;

providing a manipulation amount for editing the timbre parameters;

interpolating the timbre parameters between the first situation and the second situation in accordance with the manipulation amount to create an edited situation of the timbre parameters;

optionally selecting one of the first situation and the second situation as a default situation of the timbre parameters;

setting the desired timbre of the musical tones by the timbre parameters of the edited situation; and alternatively setting a default timbre of the musical tones by the timbre parameters of the default situation regardless of the manipulation amount as an override when the default situation is optionally designated.

* * * * *